US011476070B2

(12) United States Patent
Zhong et al.

(10) Patent No.: US 11,476,070 B2
(45) Date of Patent: Oct. 18, 2022

(54) MAGNETIC LATCHING RELAY CAPABLE OF ACCURATELY POSITIONING MAGNETIC CIRCUIT

(71) Applicant: Xiamen Hongfa Electric Power Controls Co., Ltd., Fujian (CN)

(72) Inventors: Shuming Zhong, Fujian (CN); Wenguang Dai, Fujian (CN); Guojin Liao, Fujian (CN)

(73) Assignee: Xiamen Hongfa Electric Power Controls Co., Ltd., Xiamen (CN)

( * ) Notice: Subject to any disclaimer, the term of this patent is extended or adjusted under 35 U.S.C. 154(b) by 0 days.

(21) Appl. No.: 17/314,811

(22) Filed: May 7, 2021

(65) Prior Publication Data

US 2021/0265123 A1 Aug. 26, 2021

Related U.S. Application Data

(63) Continuation of application No. 16/464,254, filed as application No. PCT/CN2017/112949 on Nov. 24, 2017, now Pat. No. 11,031,202.

(30) Foreign Application Priority Data

| | | |
|---|---|---|
| Nov. 25, 2016 | (CN) | 201611051896.1 |
| Nov. 25, 2016 | (CN) | 201611051945.1 |
| Dec. 21, 2016 | (CN) | 201611189010.X |

(51) Int. Cl.
*H01H 50/32* (2006.01)
*H01H 50/58* (2006.01)
(Continued)

(52) U.S. Cl.
CPC ..... *H01H 50/36* (2013.01); *H01H 50/32* (2013.01); *H01H 50/58* (2013.01); *H01H 50/64* (2013.01); *H01H 51/01* (2013.01)

(58) Field of Classification Search
CPC ..... H01H 50/32; H01H 50/58; H01H 50/64; H01H 51/01; H01H 50/042; H01H 50/14
See application file for complete search history.

(56) References Cited

U.S. PATENT DOCUMENTS

2019/0287749 A1 9/2019 Zhong et al.

FOREIGN PATENT DOCUMENTS

| | | |
|---|---|---|
| CN | 201 063 318 Y | 5/2008 |
| CN | 101 231 923 A | 7/2008 |

(Continued)

OTHER PUBLICATIONS

Extended European Search Report in connection with European Application No. 17874084.1, dated Aug. 18, 2020.

(Continued)

*Primary Examiner* — Mohamad A Musleh
(74) *Attorney, Agent, or Firm* — Wolf, Greenfield & Sacks, P.C.

(57) ABSTRACT

Disclosed is a magnetic latching relay capable of accurately positioning a magnetic circuit, comprising a magnetic circuit portion and a base, the magnetic circuit portion comprising a yoke, an iron core, an armature, and a bobbin, the iron core is inserted into a through-hole of the bobbin, and the yoke comprises two yokes, and one side of each of the two yokes is connected to the iron core respectively at the both ends of the through-hole of the bobbin, and the armature is fitted between the other side of each of the two yokes, the magnetic circuit portion is mounted on the base, with the axis of the through-hole of the bobbin in a horizontal manner; in at least one of the two yokes, a positioning convex portion is further provided on the outward face of the side of the yoke, positioning grooves are formed in at least one side wall to be engaged with the positioning convex portion of the yoke, to realize the positioning of the mag- (Continued)

netic circuit portions on the base in the horizontal direction perpendicular to the axis of the bobbin through hole.

9 Claims, 35 Drawing Sheets

(51) Int. Cl.

| | |
|---|---|
| ***H01H 50/64*** | (2006.01) |
| ***H01H 51/01*** | (2006.01) |
| ***H01H 50/36*** | (2006.01) |

(56) References Cited

FOREIGN PATENT DOCUMENTS

| | | | |
|---|---|---|---|
| CN | 201 112 284 | Y | 9/2008 |
| CN | 201 112 290 | Y | 9/2008 |
| CN | 201 435 353 | Y | 3/2010 |
| CN | 201 522 973 | U | 7/2010 |
| CN | 101 231 923 | B | 11/2010 |
| CN | 201 754 389 | U | 3/2011 |
| CN | 202 394 819 | U | 8/2012 |
| CN | 202 585 269 | U | 12/2012 |
| CN | 202 996 731 | U | 6/2013 |
| CN | 203 415 504 | U | 1/2014 |
| CN | 203 562 369 | U | 4/2014 |
| CN | 103 794 415 | A | 5/2014 |
| CN | 203 721 645 | U | 7/2014 |
| CN | 104 362 044 | A | 2/2015 |
| CN | 204 242 959 | U | 4/2015 |
| CN | 104 752 102 | A | 7/2015 |
| CN | 204 651 252 | U | 9/2015 |
| CN | 105 247 643 | A | 1/2016 |
| CN | 105 590 795 | A | 5/2016 |
| CN | 205 211 668 | U | 5/2016 |
| CN | 106 024 526 | A | 10/2016 |
| CN | 106 504 949 | A | 3/2017 |
| CN | 206 322 647 | U | 7/2017 |
| CN | 206 340 490 | U | 7/2017 |
| CN | 206 340 493 | U | 7/2017 |
| EP | 2911174 | A1 | 8/2015 |
| GB | 2413703 | A | 11/2005 |
| JP | S4873771 | U | 9/1973 |
| JP | S58-16425 | A | 1/1983 |
| JP | H103841 | A | 1/1998 |

OTHER PUBLICATIONS

Chinese Office Action in connection with Chinese Application No. 201611051896.1, dated Feb. 11, 2018.

Chinese Office Action in connection with Chinese Application No. 201611051945.1, dated Feb. 11, 2018.

Chinese Office Action in connection with Chinese Application No. 201611189010.X, dated Dec. 28, 2017.

International Search Report and Written Opinion for International Application No. PCT/CN2017/112949 dated Feb. 24, 2018.

International Preliminary Report on Patentability for International Application No. PCT/CN2017/112949 dated Jun. 6, 2019.

EP 21193270.2, Feb. 8, 2022, Extended European Search Report.

Extended European Search Report in connection with European Application No. 21193270.2, dated Feb. 8, 2022.

MAGNETIC LATCHING RELAY CAPABLE OF ACCURATELY POSITIONING MAGNETIC CIRCUIT

CROSS REFERENCE

This application is a Continuation of U.S. application Ser. No. 16/464,254, filed May 24, 2019, entitled "MAGNETIC LATCHING RELAY CAPABLE OF RESISTING SHORT-CIRCUIT CURRENT", which is a national stage filing under 35 U.S.C. 371 of International Patent Application Serial No. PCT/CN2017/112949, filed Nov. 24, 2017, entitled " ". Foreign priority benefits are claimed under 35 U.S.C. § 119(a)-(d) or 35 U.S.C. § 365(b) of Chinese application number 201611189010.X, filed Dec. 21, 2016, Chinese application number 201611051896.1, filed Nov. 25, 2016, and Chinese application number 201611051945.1, filed Nov. 25, 2016, the entire contents of which are incorporated herein by reference.

TECHNICAL FIELD

The present disclosure relates to a magnetic latching relay; more particularly, the present disclosure relates to a magnetic latching relay capable of accurately positioning a magnetic circuit.

BACKGROUND

The structure of the existing magnetic latching relay consists of a magnetic circuit system, a contact system, a pushing mechanism and a base. The magnetic circuit system generally consists of two substantially symmetrical magnetic circuits, including a stationary magnetizer component, a movable magnetizer component and a coil. The contact system includes a movable spring portion and a static spring portion. The pushing mechanism is generally implemented by a pushing block, and the pushing mechanism is connected between the movable magnetizer component and the movable spring portion. When positive pulse voltage is applied to the relay coil, the magnetic circuit system operates and the pushing block pushes the movable spring portion to make the contact closed, and thus the relay operates. When reverse pulse voltage is applied to the coil, the magnetic circuit system operates and the block pushes the movable spring portion to make the contact disconnected, and thus the relay is reset.

The main application area of magnetic latching relay is power metering, and the main functions are switching and metering. With the continuous deepening of power grid reforms in various countries around the world, cases of electric meter explosions and fires caused by short-circuit currents have occurred, causing huge personal safety problems and property losses. Therefore, the world's major power companies, electric meter companies have proposed relevant standards or have introduced industry standards, to standardize the ability of magnetic latching relay to resist short-circuit current, so as to improve the safety of smart meter operation. In order to ensure personal safety and safety of electrical equipment, magnetic latching relay is required to withstand and conduct short-circuit current. According to the operating characteristics of the power grid and based on the consideration of personal and equipment safety, the magnetic latching relay has three working conditions against short-circuit current.

Working condition I: the front end of the electric meter (upstream grid) is short-circuited, characterized in that the contact of the magnetic latching relay is closed (the meter is in closed state), and the short-circuit current is large. The short-circuit current here is called "safety short-circuit current to withstand", and the requirement for the magnetic latching relay to withstand short-circuit current is, when or after being subject to the short-circuit current, "no explosion, no ignition, splash free".

Working condition II: the back end of the electric meter (downstream grid) is short-circuited, characterized in that the contact of the magnetic latching relay is closed (the meter is in closed state), and the short-circuit current is small. The short-circuit current here is called "functional short-circuit current to withstand", and the magnetic latching relay is required to be "functionally normal" after being subject to the short-circuit current.

Working condition III: the back end of the meter (downstream of the grid) is short-circuited, characterized in that the contact of the magnetic latching relay is open (the meter is in open state), and the short-circuit current is small. The short-circuit current here is called "functionally conducted short-circuit current", and the magnetic latching relay is required to be "functionally normal" after conducting the short-circuit current.

Under the three working conditions, the short-circuit current varies greatly. As an example, the "safety short-circuit current to withstand" of the IEC62055-31 standard UC2 grade is 4.5 KA, which is 1.8 times of "functional short-circuit current to withstand" or "functionally conducted short-circuit current" of 2.5 KA. The "safety short-circuit current to withstand" of UC3 grade is 6 KA, which is twice of the "functional short-circuit current to withstand" or "functionally conducted short-circuit current" of 3 KA. As another example, ANSI C12.1 standard 200 A rated current level "safety short-circuit current to withstand" has a peak of 24 KA, which is 3.4 times of the peak value of 7 KA of "functional short-circuit current to withstand".

To develop a magnetic latching relay product that is resistant to short-circuit current, it is necessary to increase the closing pressure of the movable and static contacts to counteract the electric repulsion when the short-circuit current passes through the contacts. Increasing the closing pressure of the movable and static contacts will inevitably increase the size of the product and increase the power consumption of the coil control portion, which cannot meet the customer's demands for miniaturization and low power consumption of the product. At the same time, the product cost will rise sharply, resulting in a decline in the competitiveness of the product in market.

The existing design for magnetic latching relay mainly utilizes the Lorentz force principle, and resists, by means of the electromagnetic force on the movable spring (moving spring) which is generated by onefold short-circuit current, electric repulsion between the movable and static contacts which is generated by the short-circuit current. In designing a specific scheme, the intensity of the short-circuit current is closely related to the distance between the two springs, and the effect of resisting the short-circuit current is closely related to deformation of the spring (rigidity). Due to the large difference between "safety short-circuit current to withstand" and "functional short-circuit current to withstand" or "functionally conducted short-circuit current", a design that meets "safety short-circuit current to withstand" may not be compatible with "functional short-circuit current to withstand" or "functionally conducted short-circuit current", and vice versa. Similarly, designs that meet the UC3 standard may not be downward compatible with the UC2 standard.

In prior art, there are mainly two kinds of technical solutions for solving the problem on how to resist the short-circuit current by magnetic latching relay. The first one is "using the electromagnetic force generated when the current of the lead piece and the current of the movable spring are opposite to each other, to resist the electric power generated when large current passes through the movable and static contacts", as disclosed in Chinese patent application CN200710008565.4. The second one is "due to the same current direction in a parallel circuit, using the electromagnetic attraction to increase the pressure between the movable and static contacts", to achieve the function of resisting short-circuit current, as disclosed in European Patent Application EP 1 756 845 A1. In each of the above technical solutions, onefold short-circuit current flows through the movable spring (i.e., the movable spring) and the lead piece of the movable spring (i.e., the movable spring lead), and the electromagnetic force generated on the movable spring (i.e., movable spring) is resistant to the electric repulsion generated by the short-circuit current between the movable and static contacts. Therefore, the requirement to increase the closing pressure of the movable and static contacts cannot be met, and in the above second technical solution, a parallel circuit is used, so the number of movable and static contacts is doubled, and the cost of the product is increased.

SUMMARY

It is an object of the present invention to overcome the deficiencies of the prior art and to provide a magnetic latching relay that is resistant to short circuit current. By means of improvement of structure of the contact system, electromagnetic repulsion generated on the movable spring by a formed twofold short-circuit current can be used to resist the electric repulsion generated between the movable and static contacts by a onefold short-circuit current, without increasing the dimensions of the product or increasing the power consumption of the coil control portion. Thus, the closing pressure of the movable and static contacts is greatly improved to resist the short-circuit current and meet the requirements of the product for simple structure, compactness and miniaturization.

It is another object of the present invention to overcome the deficiencies of the prior art and to provide a magnetic latching relay that is resistant to short circuit current. By means of improvement of structure of the contact system, electromagnetic repulsion generated on the movable spring by a formed twofold short-circuit current can be used to resist the electric repulsion generated between the movable and static contacts by a onefold short-circuit current, without increasing the dimensions of the product or increasing the power consumption of the coil control portion. Thus, the closing pressure of the movable and static contacts is greatly improved to resist the short-circuit current and meet the requirements of the product for simple structure, compactness and miniaturization.

It is a further object of the present invention to overcome the deficiencies of the prior art and to provide a magnetic latching relay in which a contact portion is provided with anti-scraping and is accurately positioned. By means of improvement of the cooperating structure between the insertion portion of the contact portion and the base slot, scraping can be prevented, and the precise positioning of the contact portion in the base can be ensured, thereby realizing a dual design of anti-scrapping and positioning in a small space.

The technical solution adopted by the present invention to solve the technical problem is a magnetic latching relay capable of resisting short-circuit current, comprising a magnetic circuit system, a contact system and a pushing mechanism; the pushing mechanism is connected between the magnetic circuit system and the contact system, and the contact system comprises a movable spring portion and a static spring portion; the movable spring portion comprises a movable contact, a movable spring and a movable spring lead; an end of the movable spring is connected to the movable contact, and another end of the movable spring is connected to an end of the movable spring lead; the movable spring lead is provided in a thickness direction of the movable spring and on a side facing away from the movable contact, such that direction of current flowing through the movable spring lead is opposite to direction of current flowing through the movable spring; the static spring portion includes a static contact, a static spring and a static spring lead; an end of the static spring is connected to the static contact, and another end of the static spring is connected to an end of the static spring lead, and the static contact is provided at a position which is adapted to the movable contact; the static spring lead is provided in the thickness direction of the movable spring and on the side facing away from the movable contact, such that direction of current flowing through the static spring lead is also opposite to the direction of current flowing through the movable spring, thereby cooperation of the movable spring lead and the movable spring as well as cooperation of the static spring lead and movable spring are used to formed a twofold short-circuit current, so as to resist to electric repulsion generated between movable and static contacts by a onefold short-circuit current by means of an electromagnetic repulsion generated on the movable spring by the twofold short-circuit current.

The static spring is provided in the thickness direction of the movable spring and on a side of the movable spring having the movable contact; a connecting piece is provided between the static spring and the static spring lead, wherein an end of the connecting piece is connected to another end of the static spring in the thickness direction of the movable spring and on the side of the movable spring having the movable contact, and another end of the connecting piece is connected to an end of the static spring lead in the thickness direction of the movable spring and on the side facing away from the movable contact.

The static spring and the static contact are a one-piece structure or a split structure.

The static spring, the static spring lead and the connecting piece are a one-piece structure or a split structure.

The movable spring lead is provided between the movable spring and the static spring lead.

The movable spring and the movable contact are a one-piece structure or a split structure.

The movable spring and the movable spring lead are a one-piece structure or a split structure.

The movable spring and the movable spring lead are connected to form a U-shaped or V-shaped structure.

The pushing mechanism is provided with a connecting portion for operating with an end of the movable spring; the connecting portion includes a first pushing portion for pushing the movable spring to contact the movable and static contacts when the relay is operated, and a second pushing portion for pushing the movable spring to separate the movable and static contacts when the relay is reset; a connecting line of points where the first pushing portion and the second pushing portion act on the movable spring is offset from a moving direction of the pushing mechanism; and an acting point of the second pushing portion on the movable spring is closer to the movable contact than an acting point of the first pushing portion on the movable spring.

An end of the movable spring includes a first spring and a second spring, wherein the first spring is formed by a main body of the movable spring extending straight from the movable contact, and the second spring is formed by the main body of the movable spring extending and bending from the movable contact; the first spring cooperates with the second pushing portion of the pushing mechanism, and the second spring cooperates with the first pushing portion of the pushing mechanism.

The movable spring is formed by stacking multiple springs; one or more of the multiple springs are stacked to form a first movable spring group, and the first movable spring group includes the main body and the first spring; another spring or other springs of the multiple springs are stacked to form a second movable spring group, and the second movable spring group is provided with a bending line along a width direction, the main body of the movable spring and the second spring are separated by the bending line.

The bending line passes through a center of the movable contact.

The contact system is one system, comprising a group of cooperated movable spring portion and static spring portion; another end of the movable spring lead extends from a side of the magnetic latching relay, and another end of the static spring lead extends from another side of the magnetic latching relay.

An axis of a coil of the magnetic circuit system is substantially parallel or perpendicular to the movable spring of the contact system.

The contact system is two systems, comprising two groups of correspondingly cooperated movable spring portions and static spring portions, wherein another end of the movable spring lead of one contact system extends from a side of the magnetic latching relay, another end of the static spring lead of one contact system extends from another side of the magnetic latching relay, another end of the movable spring lead of the other contact system extends from another side of the magnetic latching relay, and another end of the static spring lead of the other contact system extends from a side of the magnetic latching relay.

An axis of a coil of the magnetic circuit system is substantially parallel to the movable spring of the contact system; cooperating positions of the movable and static contacts of the two contact systems are misaligned with respect to the magnetic circuit system, and the magnetic circuit system cooperates with corresponding movable springs respectively by two pushing mechanism.

The contact system is two systems, comprising two groups of correspondingly cooperated movable spring portions and static spring portions, wherein another end of the movable spring lead of each of the two contact systems extends from a side of the magnetic latching relay, and another end of the static spring lead of each of the two contact systems extends from another side of the magnetic latching relay.

An axis of a coil of the magnetic circuit system is substantially perpendicular to the movable spring of the contact system; cooperating positions of the movable and static contacts of the two contact systems are aligned with respect to the magnetic circuit system, the magnetic circuit system is disposed outside the two contact systems, and the magnetic circuit system cooperates with the two movable springs by one pushing mechanism.

An axis of a coil of the magnetic circuit system is substantially parallel to the movable spring of the contact system; cooperating positions of the movable and static contacts of the two contact systems are aligned with respect to the magnetic circuit system, the magnetic circuit system is disposed in middle of the two contact systems, and the magnetic circuit system cooperates with the two movable springs by one pushing mechanism.

The contact system is three systems, comprising three groups of correspondingly cooperated movable spring portions and static spring portions, wherein another end of the movable spring lead of the first contact system extends from a side of the magnetic latching relay, and another end of the static spring lead of the first contact system extends from another side of the magnetic latching relay; another end of the movable spring lead of the second contact system extends from another side of the magnetic latching relay, and another end of the static spring lead of the second contact system extends from a side of the magnetic latching relay; and another end of the movable spring lead of the third contact system extends from a side of the magnetic latching relay, and another end of the static spring lead of the third contact system extends from another side of the magnetic latching relay.

An axis of a coil of the magnetic circuit system is substantially parallel to the movable spring of the contact system; cooperating positions of the movable and static contacts of the first and second contact systems are misaligned with respect to the magnetic circuit system; cooperating positions of the movable and static contacts of the first and third contact systems are aligned with respect to the magnetic circuit system; and the magnetic circuit system cooperates with corresponding movable springs by two pushing mechanisms, respectively.

The contact system is three systems, comprising three groups of correspondingly cooperated movable spring portions and static spring portions, wherein another end of the movable spring lead of each of the three contact systems extends from a side of the magnetic latching relay, and another end of the static spring lead of each of the three contact systems extends from another side of the magnetic latching relay.

An axis of a coil of the magnetic circuit system is substantially perpendicular to the movable spring of the contact system; cooperating positions of the movable and static contacts of the three contact systems are aligned with respect to the magnetic circuit system, the magnetic circuit system is disposed outside the three contact systems, and the magnetic circuit system cooperates with the three movable springs by one pushing mechanism.

An axis of a coil of the magnetic circuit system is substantially parallel to the movable spring of the contact system; cooperating positions of the movable and static contacts of the three contact systems are aligned with respect to the magnetic circuit system, the magnetic circuit system is disposed in middle of the three contact systems, and the magnetic circuit system cooperates with the three movable springs by one pushing mechanism.

Compared with the prior art, the beneficial effects of the embodiments of the present invention are listed as follows.

1. In the embodiment of the present invention, the static spring lead is disposed in the thickness direction of the movable spring and on the side of the movable spring away from the movable contact, so that the current flowing through the static spring lead and the current flowing through the movable spring are in opposite directions, and the cooperation between the movable spring lead and the movable spring as well as the cooperation of the static spring lead and the movable spring can be utilized to form an electromagnetic repulsion generated in the movable spring by twofold short-circuit current, to resist electric repulsion generated between movable and static contacts by the one-fold short-circuit current. The embodiment of the invention improves the structure of the contact system, and can utilize the electromagnetic repulsion generated on the movable spring by the twofold short-circuit current without increasing the dimensions of the product or increasing the power consumption of the coil control portion, to resist the electric repulsion generated between movable and static contacts by the onefold short-circuit current, as a result, the closing pressure of the movable and static contacts is greatly increased to resist the short-circuit current, and the requirements of the product for simple, compact and miniaturized structure is met.

2. The acting point of the first pushing portion of the embodiment of the present invention is far away from the movable contact, and distance from the acting point to the center position of the movable contact (the second spring) is longer, thereby ensuring that the when the relay is in operation, the contacting pressure of the movable and static contacts generated by the second spring rises steadily from the beginning of the contact of the movable and static contacts to the completely contact of the same. Since the contacting pressure of the static and movable contacts is not abrupt and does not increase sharply, the time for the movable and static contacts to close the loop is the shortest. The second spring according to the embodiment of the present invention is longer, and in the case where the contacting pressure of the same size of the movable and static contacts is generated by the second spring, the deformation of the second spring is larger; thus, the overtravel after the closing of the movable contact is assured, which is beneficial to the electrical life of the relay.

3. The second movable spring group of the embodiment of the present invention is provided with a bending line along the width direction, and the main body of the movable spring and the second spring is separated by the bending line. The bending line passes through the center of the movable contact. After the movable and static contacts are closed, the pressure exerted on the movable contact by the pushing mechanism by means of the second spring is maximized, thereby reducing the contacting resistance after the movable and static contacts are closed.

4. The second pushing portion of the embodiment of the invention is close to the movable contact to ensure that during the returning process, the torque transmitted by the pushing mechanism to the movable contact by means of the movable spring is maximized, thereby the stickiness generated between the movable and static contacts is better overcome, and the contact system can be quickly and forcefully disconnected.

According to any one of the above embodiments, a magnetic latching relay capable of accurately positioning a magnetic circuit is provided, which includes a magnetic circuit portion and a base. The magnetic circuit portion includes a yoke, a core, an armature, and a bobbin. The iron core is inserted into a through-hole of the bobbin, and the yoke comprises two yokes, and one side of each of the two yokes is connected to the iron core respectively at the both ends of the through-hole of the bobbin and. The armature is fitted between the other side of each of the two yokes. The magnetic circuit portion is mounted on the base, with the axis of the through-hole of the bobbin in a horizontal manner. In at least one of the two yokes, a positioning convex portion is further provided on the outward face of the side of the yoke. Positioning grooves are formed in at least one side wall to be engaged with the positioning convex portion of the yoke, to realize the positioning of the magnetic circuit portions on the base in the horizontal direction perpendicular to the axis of the bobbin through hole.

According to any one of the above embodiments, the positioning groove of the side wall of the base has an elongated shape, and the longitudinal direction of the positioning groove is disposed along the vertical direction.

According to any one of the above embodiments, the positioning groove of the side wall of the base is formed by two ribs of the side wall which are outwardly protruding and along the vertical direction.

According to any one of the above embodiments, the positioning groove of the side wall of the base is formed by an inwardly recessed structure of the side wall.

According to any one of the above embodiments, the positioning convex portion of the yoke is composed of two cylinders which are arranged in the vertical direction.

According to any one of the above embodiments, the positioning convex portion of the yoke is composed of a rectangular parallelepiped, the length direction of which is along the vertical direction.

According to any one of the above embodiments, when the magnetic circuit portion is mounted on the base, the bottom end faces of the two ends of the bobbin and the bottom end faces of the other sides of the two yokes are mounted as mounting faces on the inner surface of the base. A boss for positioning is further disposed among a bottom end surface of both ends of the bobbin, a bottom end surface of each of the other sides of the two yokes, and a corresponding position of the inner surface of the base to realize the positioning of the magnetic circuit portion on the base in a downward direction in the vertical direction perpendicular to the axis of the bobbin through hole.

According to any one of the above embodiments, the positioning bosses are respectively formed to protrude downward along the bottom end faces of two ends of the bobbin and the bottom end faces of the other sides of the two yokes.

According to any one of the above embodiments, the positioning bosses are respectively protruded upward along the inner surface of the base at positions corresponding to the bottom end faces of two ends of the bobbin and the bottom end faces of the other sides of the two yokes.

According to any one of the above embodiments, a magnetic latching relay in which the contact portion is assembled with function of anti-scraping and is positioned accurately is provided, which includes a metal insertion portion of a contact portion and a slot of a base. The metal insertion portion is composed of two segments having different depth dimensions corresponding to the slot. When one segment of the metal insertion portion is fitted to the bottom wall of the slot, a preset gap is formed between the other segment of the metal insertion portion and the bottom wall of the slot of the base. The slot is formed by two segments having different thickness dimensions corresponding to the metal insertion portions. When the two side walls of one segment of the slot are adapted to the two sides of the thickness of the metal insertion portion, the two side walls of the other segment of the slot and the two sides of the thickness of the metal insertion portion respectively form a preset gap. One segment of the metal insertion portions cooperates with the other segment of the slot, and the other segment of the metal insertion portion cooperates with one segment the slots.

According to any one of the above embodiments, the other segment of the metal insertion portion of the contact portion is formed by a notch provided on the contact portion at the bottom side.

According to any one of the above embodiments, the bottom end of at least one side of two sides of the thickness of the other segment of the metal insertion portion of the contact portion is chamfered.

According to any one of the above embodiments, the bottom end of two sides of the thickness of the other segment of the metal insertion portion of the contact portion is chamfered.

According to any one of the above embodiments, the upper end of at least one side wall of the two side walls of one segment of the slot of the base is chamfered.

According to any one of the above embodiments, the upper ends of the two side walls of one segment of the slot of the base are chamfered.

According to any one of the above embodiments, one segment of the slot of the base is formed by adding a rib along the depth direction of the slot to the two side walls of the slot of the base.

The embodiments of the present invention will be further described in detail below with reference to the accompanying drawings; however, the magnetic latching relay capable of resisting short-circuit current of the present invention is not limited to the described embodiments.

DETAILED DESCRIPTION

Embodiment 1

Figure 1:
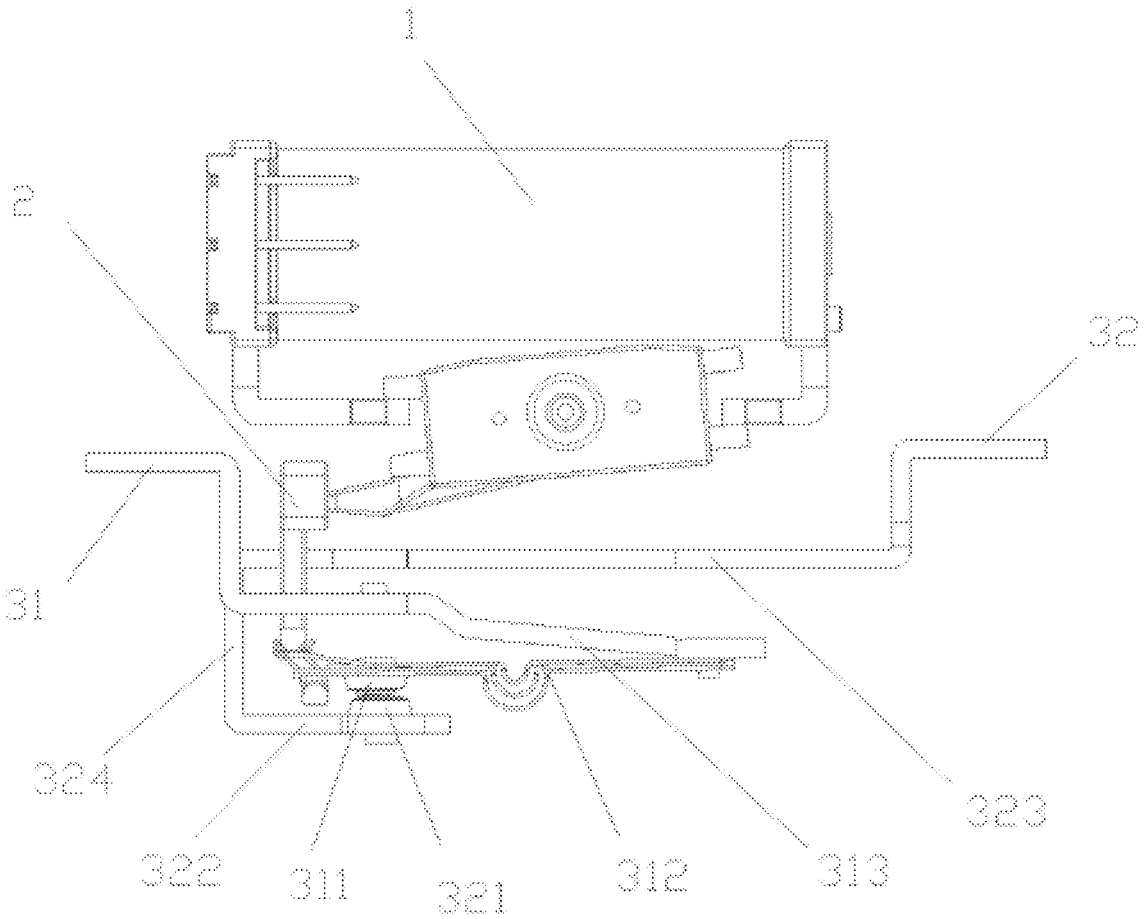
FIG. 1 is a schematic view of the structure of Embodiment 1 of the present invention (with contacts closed).
Figure 2:
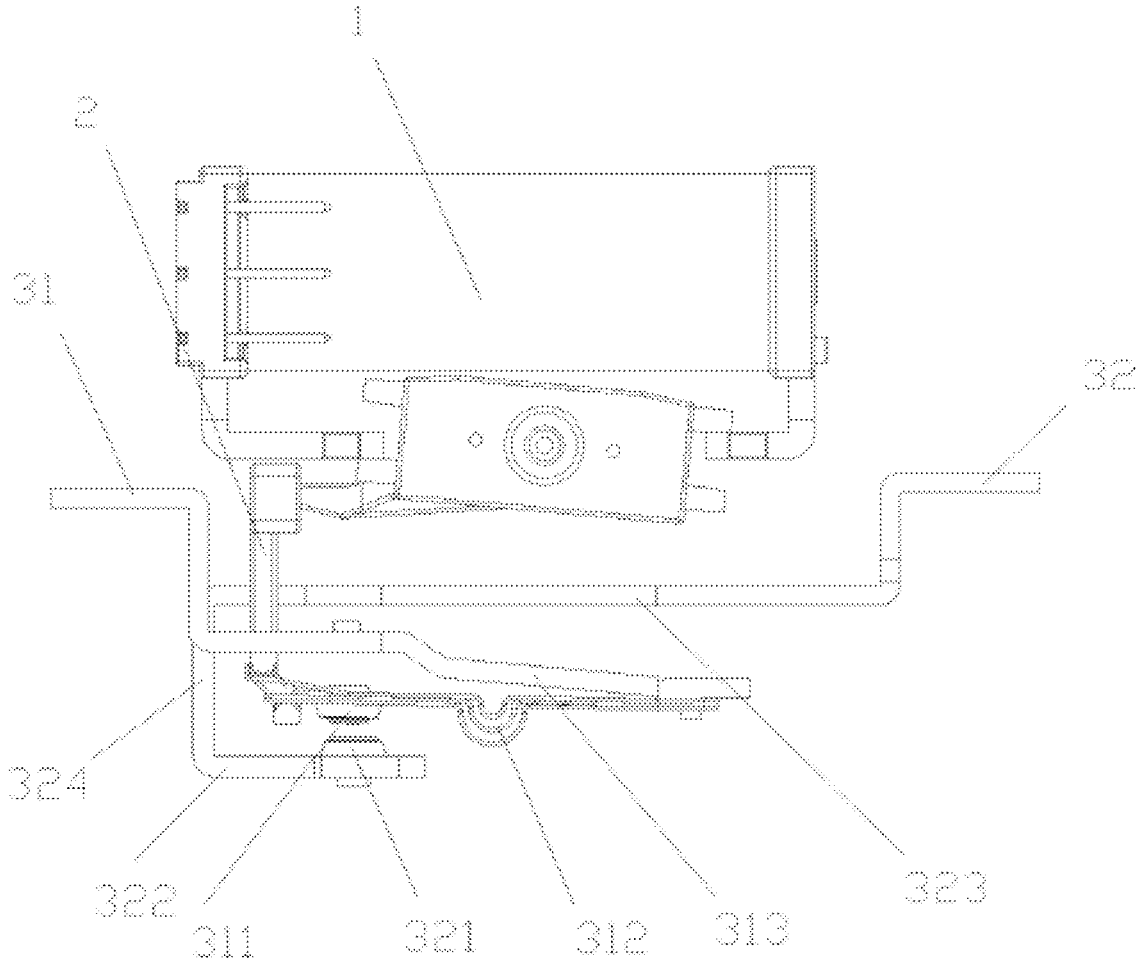
FIG. 2 is a schematic view of the structure of Embodiment 1 of the present invention (with contacts disconnected).
Figure 3:
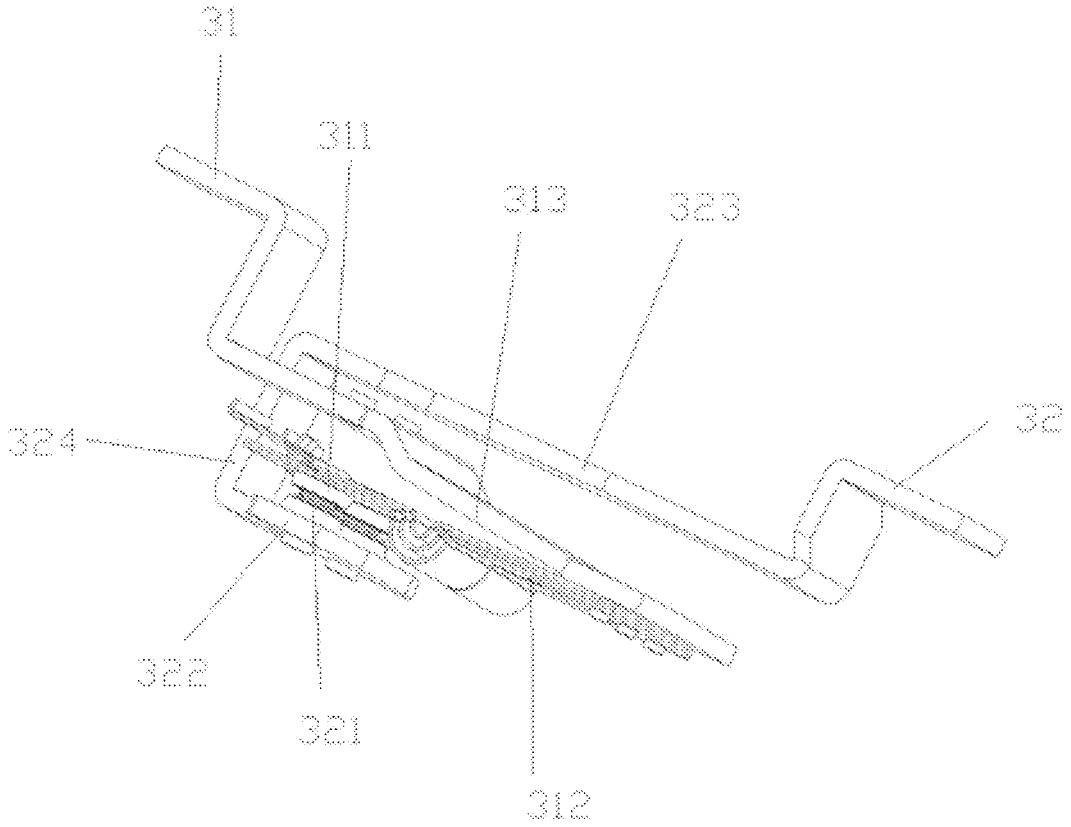
FIG. 3 is a perspective view of a contact system according to Embodiment 1 of the present invention.

Referring to FIG. 1 to FIG. 3, a magnetic latching relay capable of resisting a short-circuit current according to an embodiment of the present invention includes a magnetic circuit system 1, a contact system and a pushing mechanism 2. The pushing mechanism 2 is connected between the magnetic circuit system 1 and the contact system. The contact system includes a movable spring portion and a static spring portion. In this embodiment, the contact system is one system, including a group of cooperated movable spring portion and static spring portion, that is, one movable spring portion 31 and one static spring portion 32. The movable spring portion 31 includes a movable contact 311, a movable spring 312 and a movable spring lead 313. An end of the movable spring 312 is connected to the movable contact 311, and another end of the movable spring 312 is connected to an end of the movable spring lead 313. The movable spring lead 313 is disposed in the thickness direction of the movable spring 312 and is on the side away from the movable contact 311, such that the direction of current flowing through the movable spring lead 313 and the direction of current flowing through the movable spring 312 are opposite. The static spring portion 32 includes a static contact 321, a static spring 322 and a static spring lead 323. An end of the static spring 322 is connected to the static contact 321, and another end of the static spring 322 is connected to an end of the static spring lead 323. The static contact 321 is provided at a position that is adapted to the movable contact 311. The static spring lead 323 is disposed in the thickness direction of the movable spring and is on the side away from the movable contact, so that the current flowing through the static spring lead 323 and the current flows through the movable spring 312 are in opposite directions. Therefore, the cooperation of the movable spring lead 313 and the movable spring 312 as well as the cooperation of the static spring lead 323 and the movable spring 312 can be utilized to form a twofold short-circuit current to generate an electromagnetic repulsion force, so as to resist the electric repulsion generated between the movable and static contacts by onefold short-circuit current.

In this embodiment, the static spring 322 is disposed in the thickness direction of the movable spring 312 and on the side of the movable spring 312 having the movable contact 311. A connecting piece 324 is further disposed between the static spring piece 322 and the static spring lead 323. In the thickness direction of the movable spring and on the side of the movable spring having the movable contact, an end of the connecting piece 324 is connected to another end of the static spring 322. In the thickness direction of the movable spring and on the side of the movable spring away from the movable contact, another end of the connecting piece 324 is connected to an end of the static spring lead 323. It should be noted that the connecting piece may be omitted; on this condition, the static spring 322 is connected to the static spring lead 323 by the extension and bending of the static spring lead 322, or the static spring lead 323 is connected to the static spring 321 by the extension and bending of the static spring lead 323.

In this embodiment, the connecting piece 324 is disposed outside the head (i.e., the end provided with the movable contact) of the movable spring 312, that is, the connecting piece 324 is connected between the static spring 322 and the static spring lead 323, outside the head of the movable spring 312.

In this embodiment, the static spring 322 and the static contact 321 exhibit a split structure, that is, two separate parts. Of course, the static spring 322 and the static contact 321 may also be a one-piece structure, i.e., forming an integral part.

In this embodiment, the static spring 322, the static spring lead 323 and the connecting piece 324 exhibit a one-piece structure. Of course, the static spring, the static spring lead and the connecting piece may also be a split structure.

In this embodiment, the movable spring lead 313 is positioned between the movable spring 312 and the static spring lead 323.

In this embodiment, the movable spring 312 and the movable contact 311 exhibit a split structure, that is, two separate parts. Of course, the movable spring 312 and the movable contact 311 may also be a one-piece structure, i.e., forming an integral part.

In this embodiment, the movable spring 312 and the movable spring lead 313 exhibit a split structure, that is, two separate parts. Of course, the movable spring 312 and the movable spring lead 313 may also be a one-piece structure, i.e., forming an integral part.

In this embodiment, the movable spring 312 and the movable spring lead 313 is connected to form a V-shaped structure; alternatively, the movable spring 312 and the movable spring lead 313 is connected to form a U-shaped structure.

In this embodiment, another end of the movable spring lead 313 extends from a side of the magnetic latching relay, and another end of the static spring lead 323 extends from another side of the magnetic latching relay.

In this embodiment, an axis of a coil of the magnetic circuit system 1 is substantially parallel to the movable spring 312 of the contact system.

According to the Lorentz force principle, a magnetic field will be generated between two parallel conductors or approximately parallel conductors if currents flow through the conductors in opposite directions, which generates an electromagnetic force that makes the conductors interact with each other.

Figure 4:
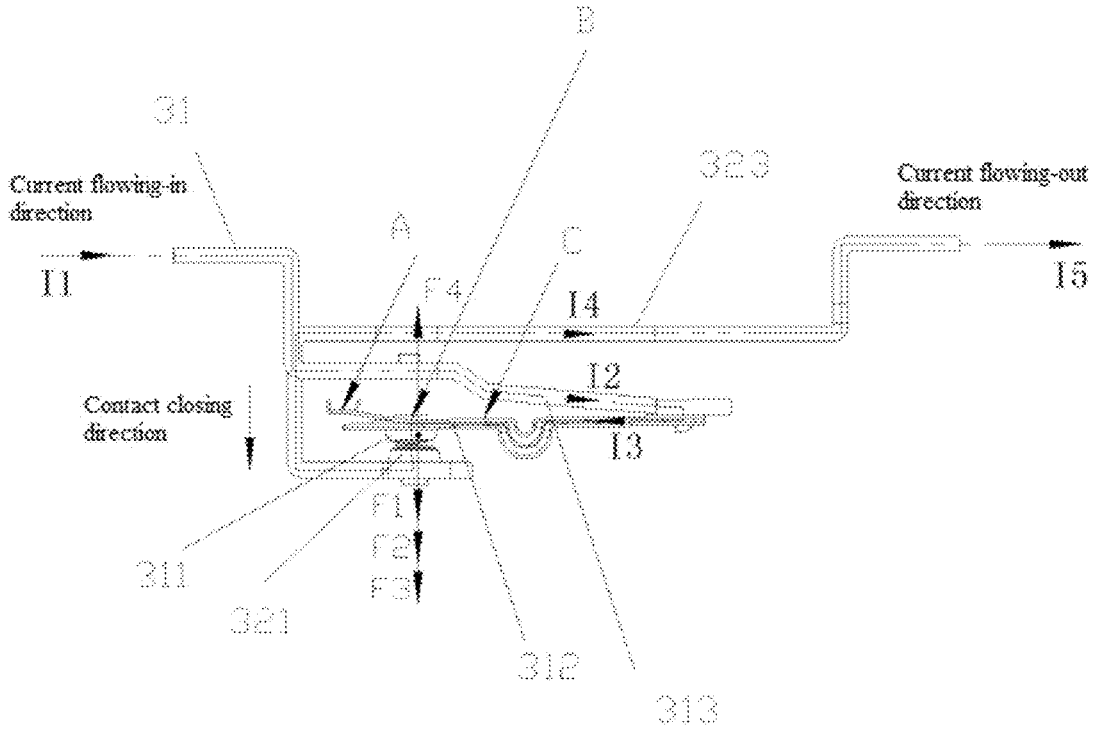
FIG. 4 is a schematic view of the stress state of contacts of the contact system according to Embodiment 1 of the present invention.
Figure 5:
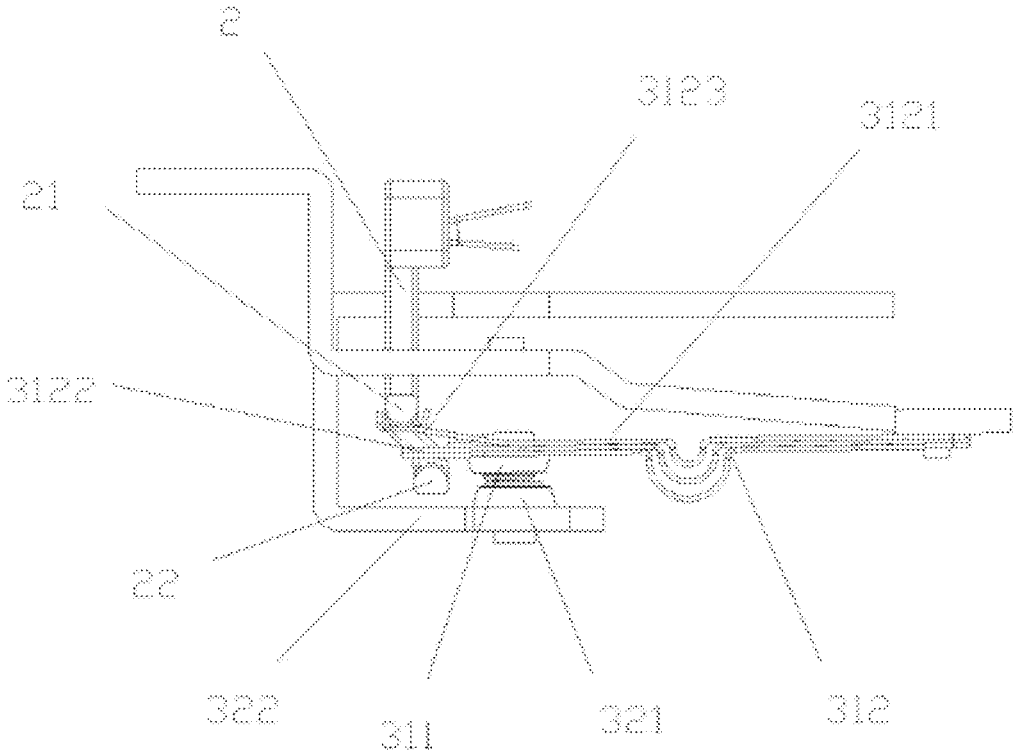
FIG. 5 is a schematic view of the cooperation (with contacts closed) of a movable spring and a pushing mechanism according to Embodiment 1 of the present invention.
Figure 6:
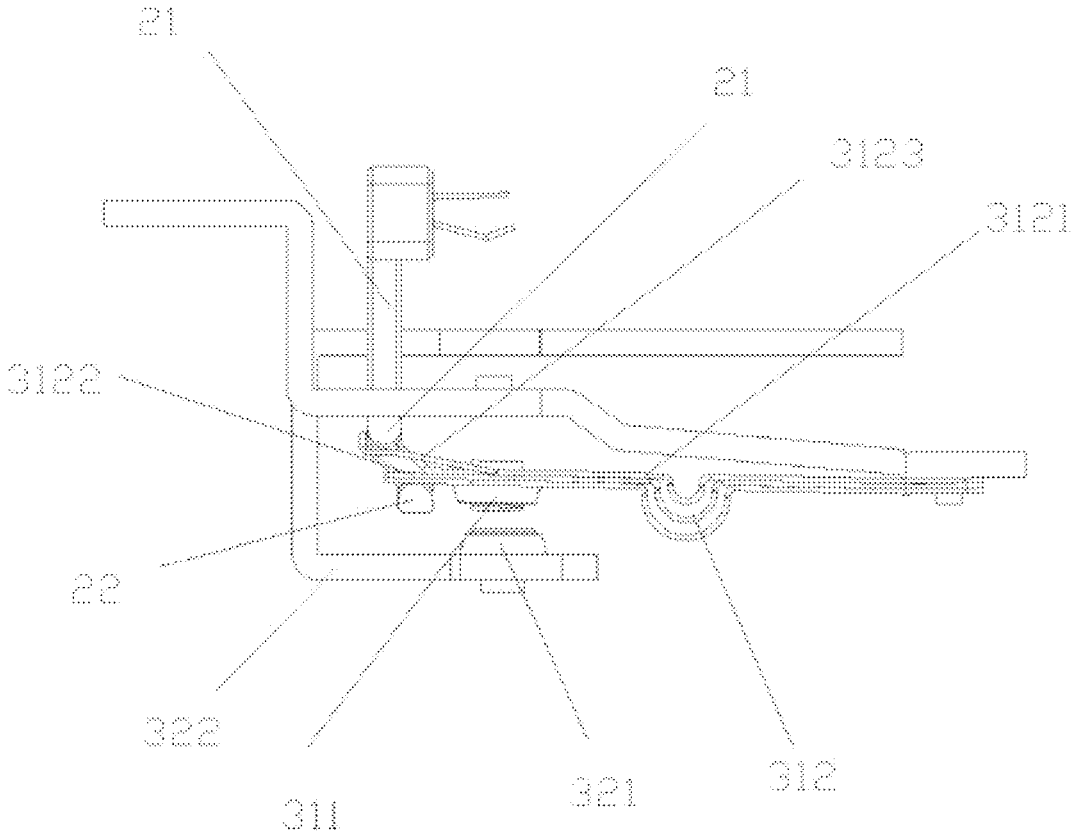
FIG. 6 is a schematic view of the cooperation (with contacts disconnected) of a movable spring and a pushing mechanism according to Embodiment 1 of the present invention.
Figure 7:
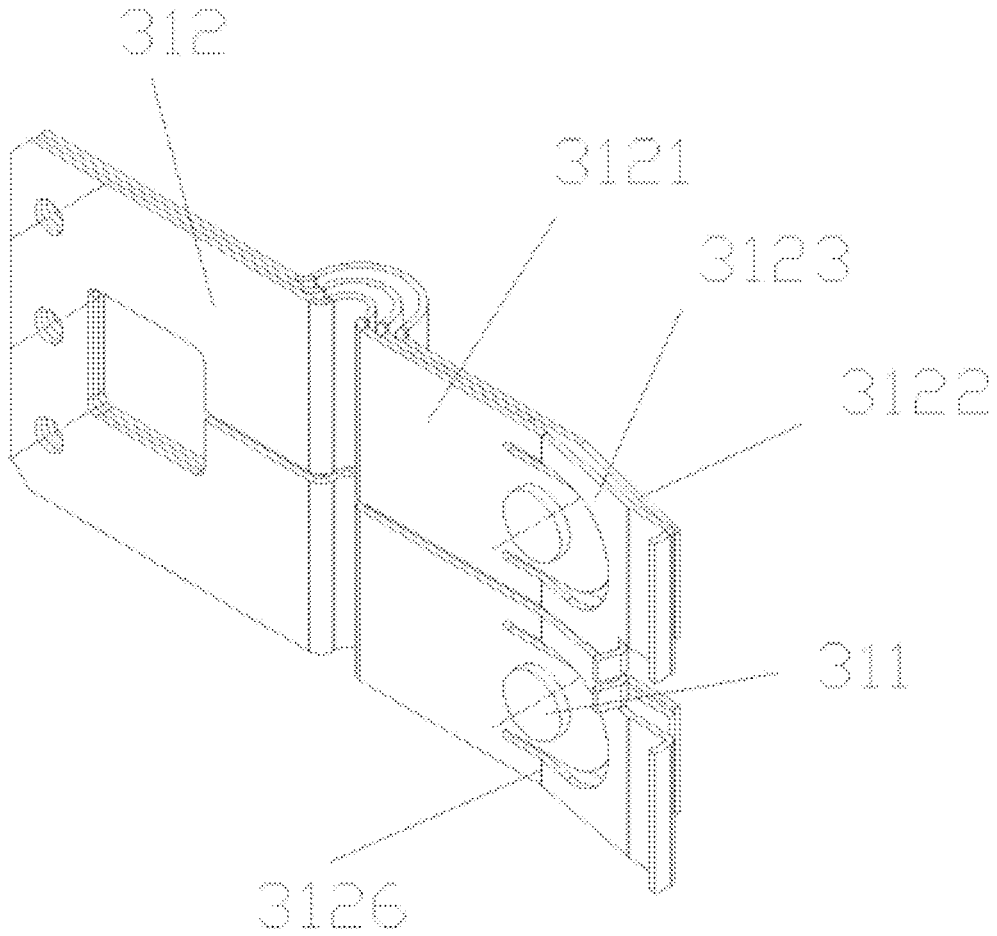
FIG. 7 is a perspective view of a movable spring according to Embodiment 1 of the present invention.
Figure 8:
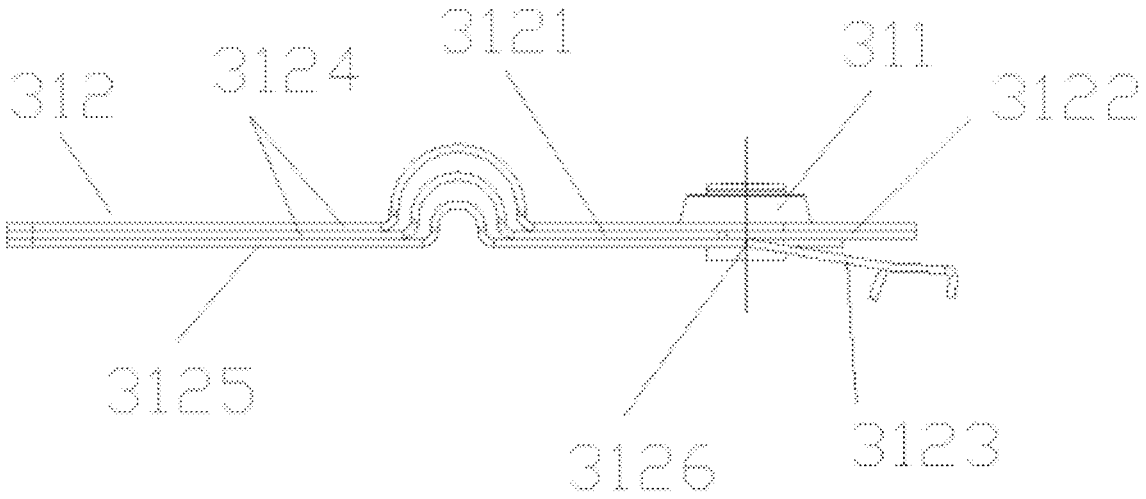
FIG. 8 is a front view of a movable spring according to Embodiment 1 of the present invention.
Figure 9:
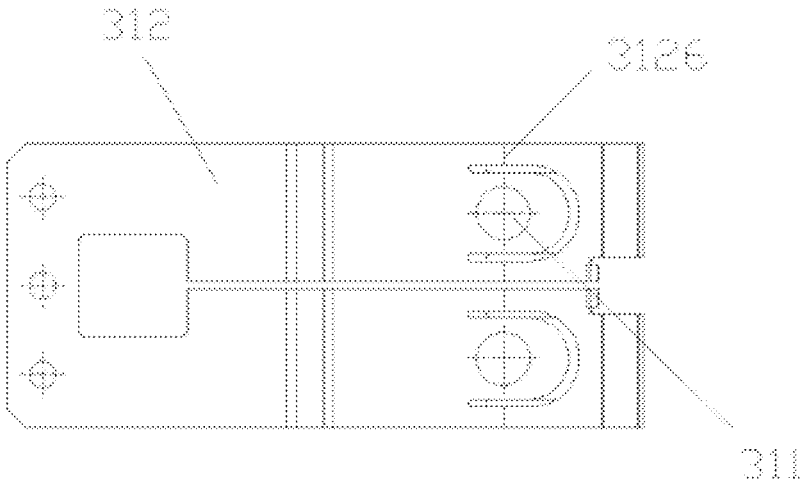
FIG. 9 is a bottom view of a movable spring according to Embodiment 1 of the present invention.

Referring to FIG. 4, the current I1=I2=I3=I4=I5. The current flows in the direction shown by I1 in FIG. 4, and the current I1 flows through direction shown by I2, I3, I4 and I5. Of course, the current can also flow in an opposite direction, that is, the current flows in the direction shown by I5 in FIG. 4, and sequentially flows through direction shown by I4, I3, I2 and I1. The movable spring 312 and the movable contact 311 thereon are movable conductors; the movable spring lead 313 and the static spring lead 323 are fixed conductors. The current I3 flows through the movable spring 312. The magnitude of I3 is equal to that of the current I2 on the movable spring lead 313, while the flow direction of I3 is opposite or substantively opposite to that of I2; thus, an electromagnetic force F1 is generated on the movable spring 312, and the electromagnetic force F1 acts on the movable spring 312 and the movable contact 311. The direction of the electromagnetic force F1 is vertically downward or oblique downward as shown in FIG. 4, which is the same or approximately the same as the contact closing direction. The current I4 flows through the static spring lead 323. The magnitude of I4 is equal to that of the current I2 on the movable spring 312, while the flow direction of I4 is opposite or substantively opposite to that of I2; thus, an electromagnetic force F2 is generated on the movable spring 312, and the electromagnetic force F2 acts on the movable spring 312 and the movable contact 311. The direction of the electromagnetic force F2 is vertically downward or oblique downward as shown in FIG. 4, which is the same or approximately the same as the contact closing direction. Force F3 is a pushing force for a pushing card, and acts on the movable spring 312 and its movable contact 311. The direction of force F3 is vertically downward or oblique downward as shown in FIG. 4, which is the same or approximately the same as the contact closing direction. The pushing card can be in direct contact with the movable spring or the movable contact, or in indirectly contact with the movable spring or the movable contact through other parts. A first kind of contact point is shown in point A of FIG. 4, and the contact point A is located on the left side of the movable contact. A second kind contact point is shown as point B in FIG. 4, and this contact point is on the movable contact. A third kind of contact point is shown as point C in FIG. 4, and this contact point is located on the right of the movable contact. The force F4 is an electric repulsion force between the movable and static contacts, acting on the movable contact, and the direction of force F4 is vertically upward, opposite to the contact closing direction. In prior art, only the electromagnetic force F1 and the pushing force F3 are combined, and the direction of the combined force is opposite to the electric repulsion force F4 on the movable contact, to prevent the movable and static contacts from changing, by the electric repulsion, from a closed state to an open state or to a closed state in which reliable contact cannot be realized. Embodiments of the invention introduces the electromagnetic force F2 by specific structural layout design of the static spring, and the combined force of the electromagnetic forces F2, F1 and the pushing force F3 is greater than the combined force of the electromagnetic force F1 and the pushing force F3 in prior art, improving the reliability of the contact of the static and movable contacts if short circuit or fault current occurs.

In the embodiment of the present invention, the static spring lead is disposed in the thickness direction of the movable spring and on the side of the movable spring away from the movable contact, so that the current flowing through the static spring lead and the current flowing through the movable spring are in opposite directions, and the cooperation between the movable spring lead and the movable spring as well as the cooperation of the static spring lead and the movable spring can be utilized to form an electromagnetic repulsion generated in the movable spring by twofold short-circuit current, to resist electric repulsion generated between movable and static contacts by the one-fold short-circuit current. The embodiment of the invention improves the structure of the contact system, and can utilize the electromagnetic repulsion generated on the movable spring by the twofold short-circuit current without increasing the dimensions of the product or increasing the power consumption of the coil control portion, to resist the electric repulsion generated between movable and static contacts by the onefold short-circuit current, as a result, the closing pressure of the movable and static contacts is greatly increased to resist the short-circuit current, and the requirements of the product for simple, compact and miniaturized structure is met.

Referring to FIG. 5 to FIG. 9, the pushing mechanism 2 is provided with a connecting portion for operating with an end of the movable spring. The connecting portion includes a first pushing portion 21 for pushing the movable spring to contact the movable and static contacts when the relay is operated, and a second pushing portion 22 for pushing the movable spring to separate the movable and static contacts when the relay is reset. A connecting line of the points where the first pushing portion 21 and the second pushing portion 22 act on the movable spring is offset from the moving direction of the pushing mechanism, and the acting point of the second pushing portion 22 on the movable spring is closer to the movable contact 311 than that of the first pushing portion 21 on the movable spring.

In this embodiment, an end of the movable spring 312 includes a first spring 3122 and a second spring 3123, wherein the first spring is formed by a main body 3121 of the movable spring extending straight from the movable contact, and the second spring is formed by the main body 3121 of the movable spring extending and bending from the movable contact. The first spring 3122 cooperates with the second pushing portion 22 of the pushing mechanism, and the second spring 3123 cooperates with the first pushing portion 21 of the pushing mechanism.

In this embodiment, the movable spring 312 is formed by stacking three springs, wherein two of the three spring are stacked to form a first movable spring group 3124. The first movable spring group 3124 includes the main body 3121 and the first spring 3122. Another spring of the three springs constitutes a second movable spring group 3125, and the second movable spring group 3125 is provided with a bending line 3126 along the width direction, the main body 3121 of the movable spring and the second spring 3123 are separated by the bending line 3126.

In this embodiment, the bending line 3126 passes through the center of the movable contact 311.

In this embodiment, the bending line of the bending portion of the movable spring 312 coincides with the center line of the contact, such that the contacting pressure exerted on the movable contact 311 by the force generated by the bending portion of the movable spring is maximized, so as to ensure that when the contact is in the closed state, there is a sufficient contacting pressure to reduce the contact resistance. Of course, the bending line of the movable spring may not be provided at the center line of the contact, and may move to the left side of the center line of the vertical direction of the contact, or move to the right side of the center line of the vertical direction of the contact, so as to adjust the contacting pressure when the contact is closed by changing the position of the bending line of the movable spring.

The acting point of the first pushing portion of the embodiment of the present invention is far away from the movable contact, and distance from the acting point to the center position of the movable contact (the second spring) is longer, thereby ensuring that when the relay is in operation, the contacting pressure of the movable and static contacts generated by the second spring rises steadily from the beginning of the contact of the movable and static contacts to the completely contact of the same. Since the contacting pressure of the static and movable contacts is not abrupt and does not increase sharply, the time for the movable and static contacts to close the loop is the shortest. The second spring according to the embodiment of the present invention is longer, and in the case where the contacting pressure of the same size of the movable and static contacts is generated by the second spring, the deformation of the second spring is larger; thus, the overtravel after the closing of the movable contact is assured, which is beneficial to the electrical life of the relay.

The second movable spring group of the embodiment of the present invention is provided with a bending line along the width direction, and the main body of the movable spring and the second spring is separated by the bending line. The bending line passes through the center of the movable contact. After the movable and static contacts are closed, the pressure exerted on the movable contact by the pushing mechanism by means of the second spring is maximized, thereby reducing the contacting resistance after the movable and static contacts are closed.

The second pushing portion of the embodiment of the invention is close to the movable contact to ensure that during the returning process, the torque transmitted by the pushing mechanism to the movable contact by means of the movable spring is maximized, thereby the stickiness generated between the movable and static contacts is better overcome, and the contact system can be quickly and forcefully disconnected.

The group of contact loops of this embodiment is normally open or normally closed.

Embodiment 2

Figure 10:
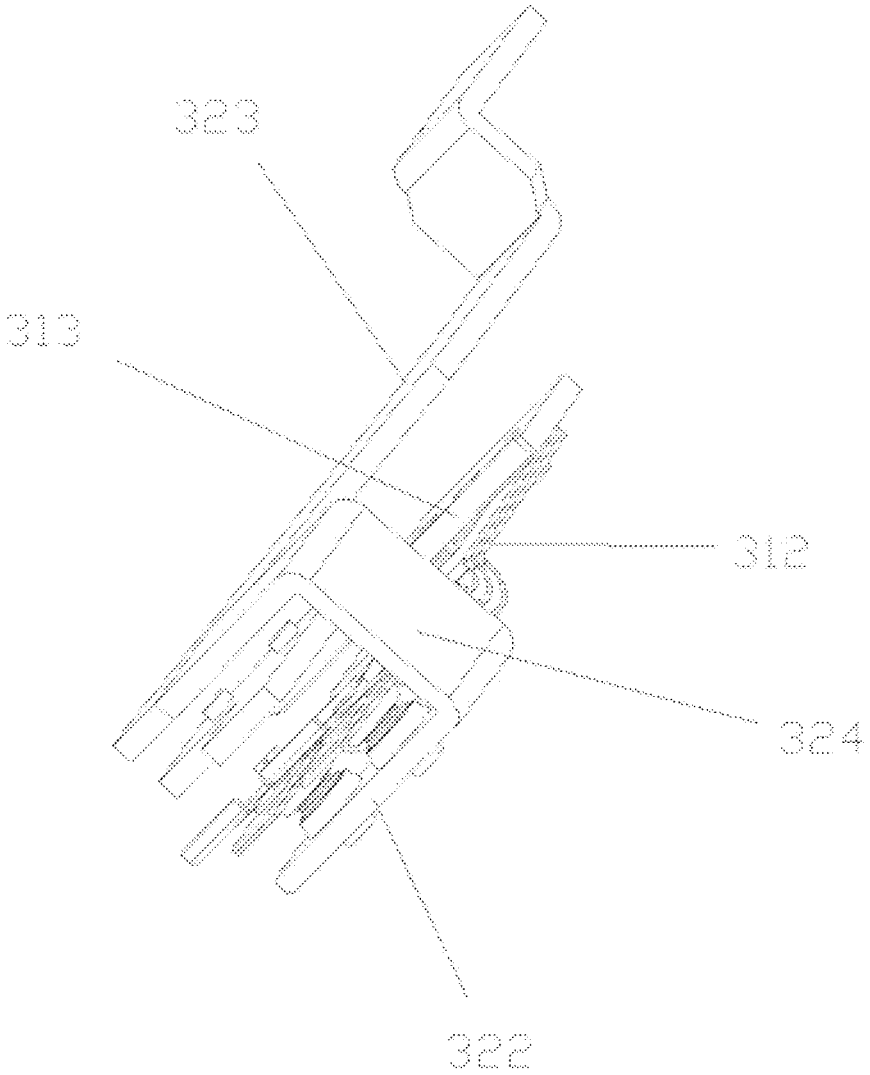
FIG. 10 is a perspective view of a contact system according to Embodiment 2 of the present invention.

Referring to FIG. 10, a magnetic latching relay capable of resisting short-circuit current according to Embodiment 2 of the present invention differs from that of Embodiment 1 in that the structure of the connecting piece 324 is different. In this embodiment, the connecting piece 324 is U-shaped, and the connecting piece 324 bypasses a head of the movable spring 312 from a side of the head of the movable spring 312, and is connected between the static spring 322 and the static spring lead 323.

Embodiment 3

Figure 11:
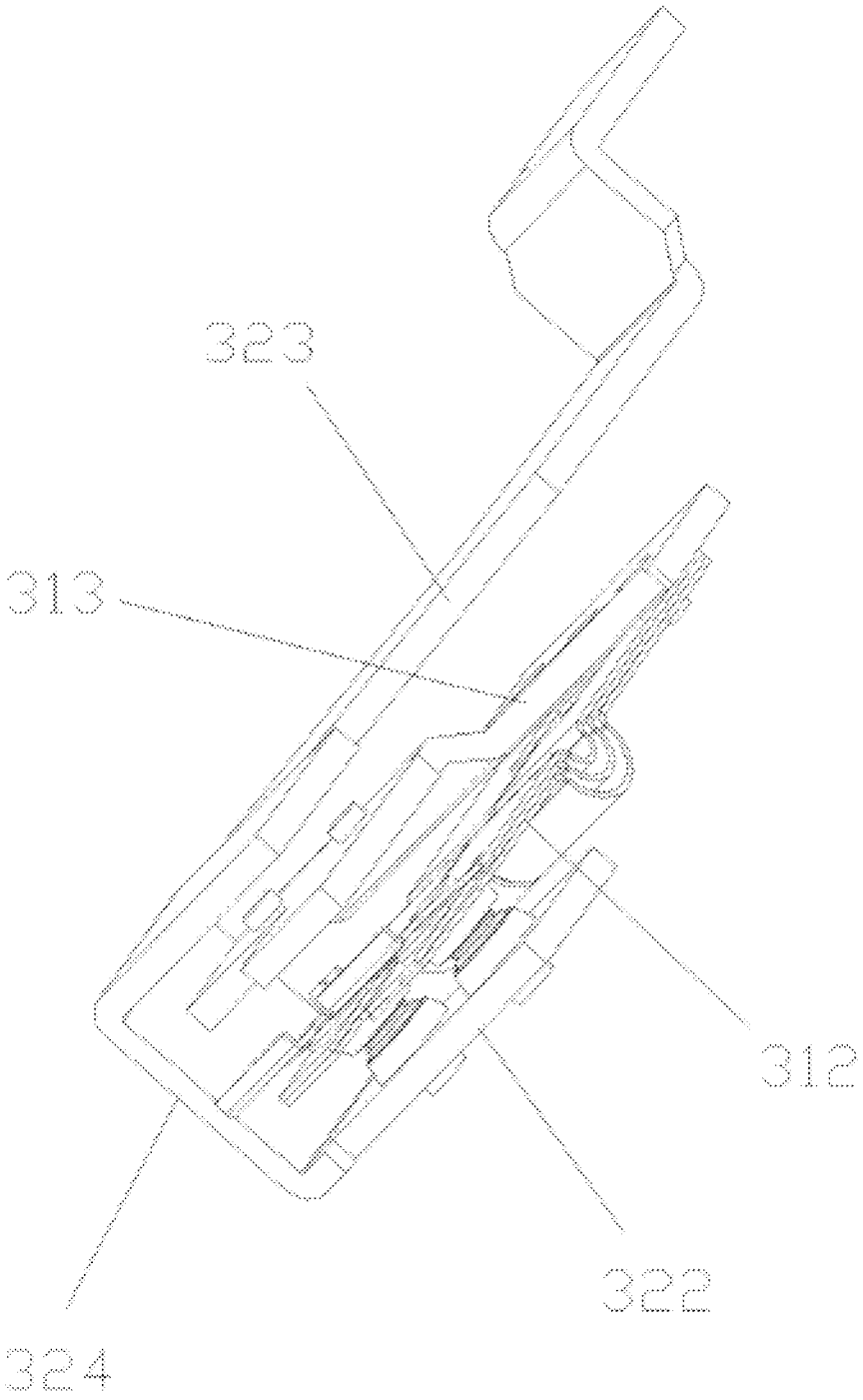
FIG. 11 is a perspective view of a contact system according to Embodiment 3 of the present invention.

Referring to FIG. 11, a magnetic latching relay capable of resisting short-circuit current according to Embodiment 3 of the present invention differs from that of Embodiment 1 in that the structure of the connecting piece 324 is different. In this embodiment, the connecting piece 324 is U-shaped, and the connecting piece 324 bypasses the head of the movable spring 312 from another side of the head of the movable spring 312, and is connected between the static spring 322 and the static spring lead 323.

Embodiment 4

Figure 12:
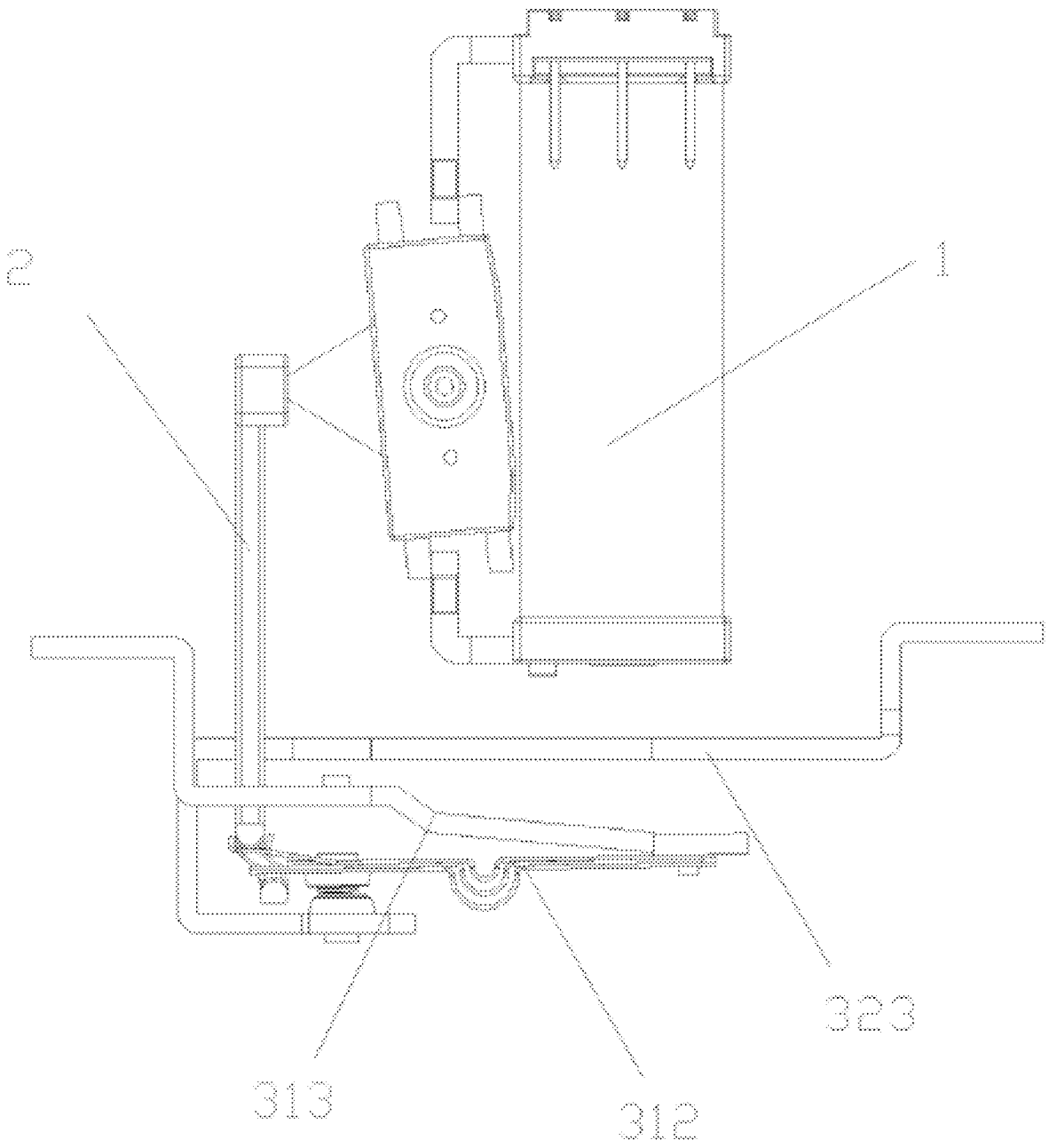
FIG. 12 is a schematic view of the structure of Embodiment 4 of the present invention (with contacts closed).
Figure 13:
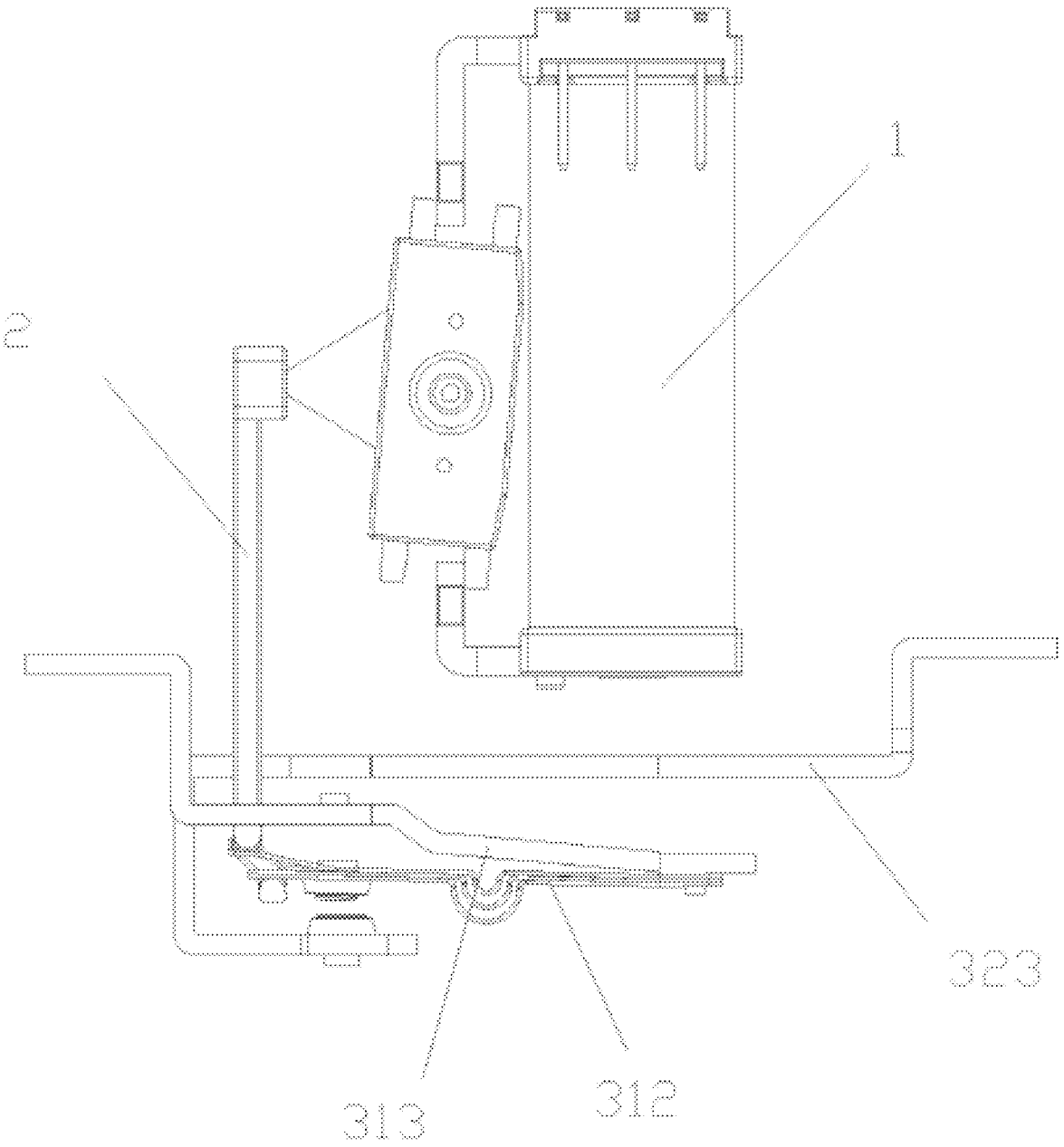
FIG. 13 is a schematic view of the structure of Embodiment 4 of the present invention (with contacts disconnected).

Referring to FIGS. 12 to 13, a magnetic latching relay capable of resisting a short-circuit current according to Embodiment 4 of the present invention differs from that of Embodiment 1 in that the axis of the coil of the magnetic circuit system 1 is substantially perpendicular to the movable spring 312 of the contact system.

Embodiment 5

Figure 14:
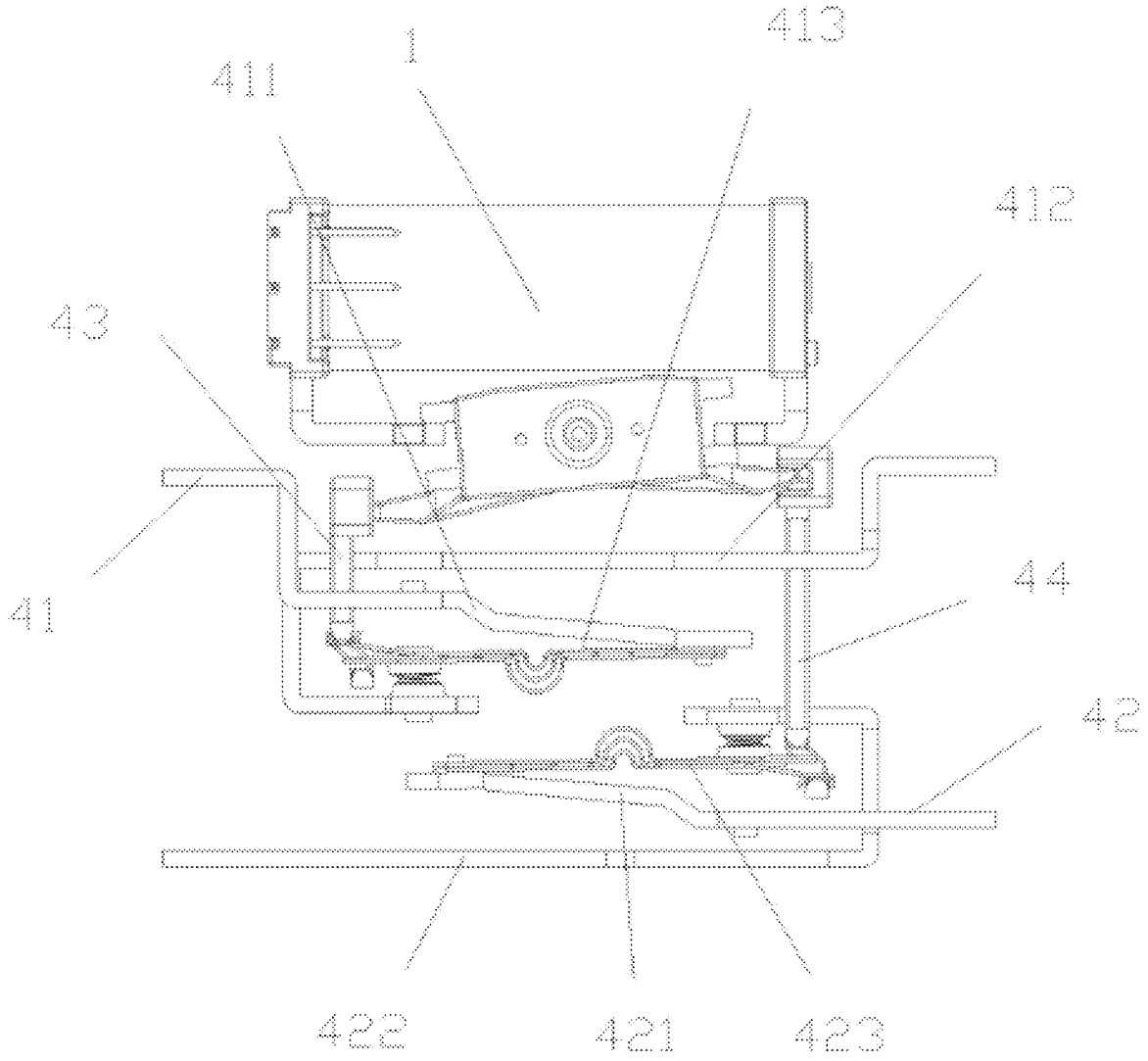
FIG. 14 is a schematic view of the structure of Embodiment 5 of the present invention (with contacts closed).
Figure 15:
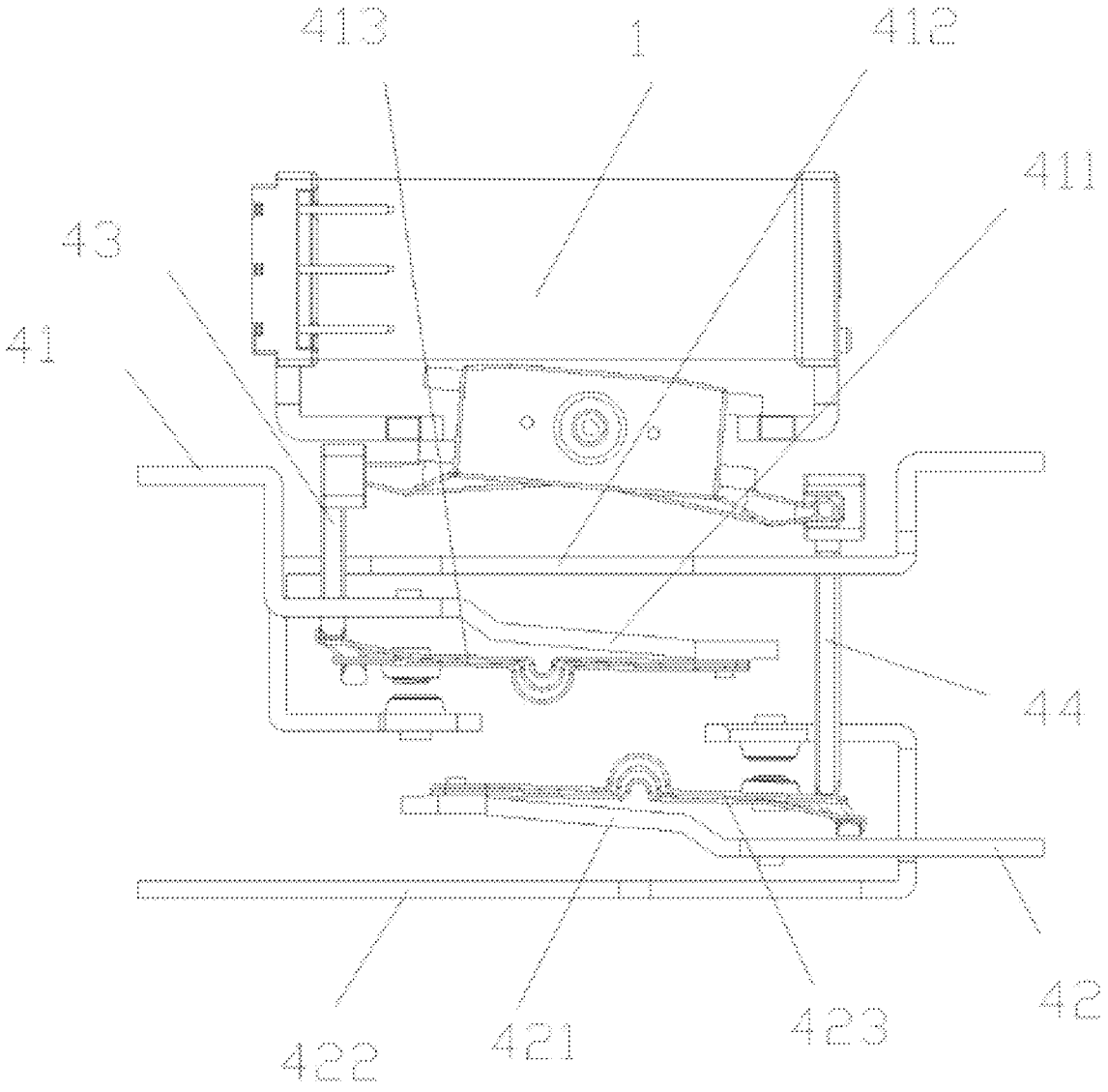
FIG. 15 is a schematic view of the structure of Embodiment 5 of the present invention (with contacts disconnected).

Referring to FIGS. 14 to 15, a magnetic latching relay capable of resisting a short-circuit current according to Embodiment 5 of the present invention differs from that of Embodiment 1 in that the contact system is two systems, comprising two groups of movable spring portions and static spring portions corresponding to each other. Another end of the movable spring lead 411 of one contact system 41 extends from a side of the magnetic latching relay, and another end of the static spring lead 412 extends from another side of the magnetic latching relay. Another end of the movable spring lead 421 of the other contact system 42 extends from another side of the magnetic latching relay, and another end of the static spring lead 422 extends from a side of the magnetic latching relay.

In this embodiment, the axis of the coil of the magnetic circuit system 1 is substantially parallel to the movable spring 413 and the movable spring 423 of the contact system, and the cooperating positions of the movable and static contacts of the two contact systems are misaligned with respect to the magnetic circuit system. The magnetic circuit system 1 cooperates with the corresponding movable springs by two pushing mechanisms, that is, the magnetic circuit system 1 cooperates with the movable spring 413 by the pushing mechanism 43, and the magnetic circuit system 1 cooperates with the movable spring 423 by the pushing mechanism 44.

In this embodiment, there are two groups of contact circuits, which are two groups of normally open or normally closed contact circuits.

Embodiment 6

Figure 16:
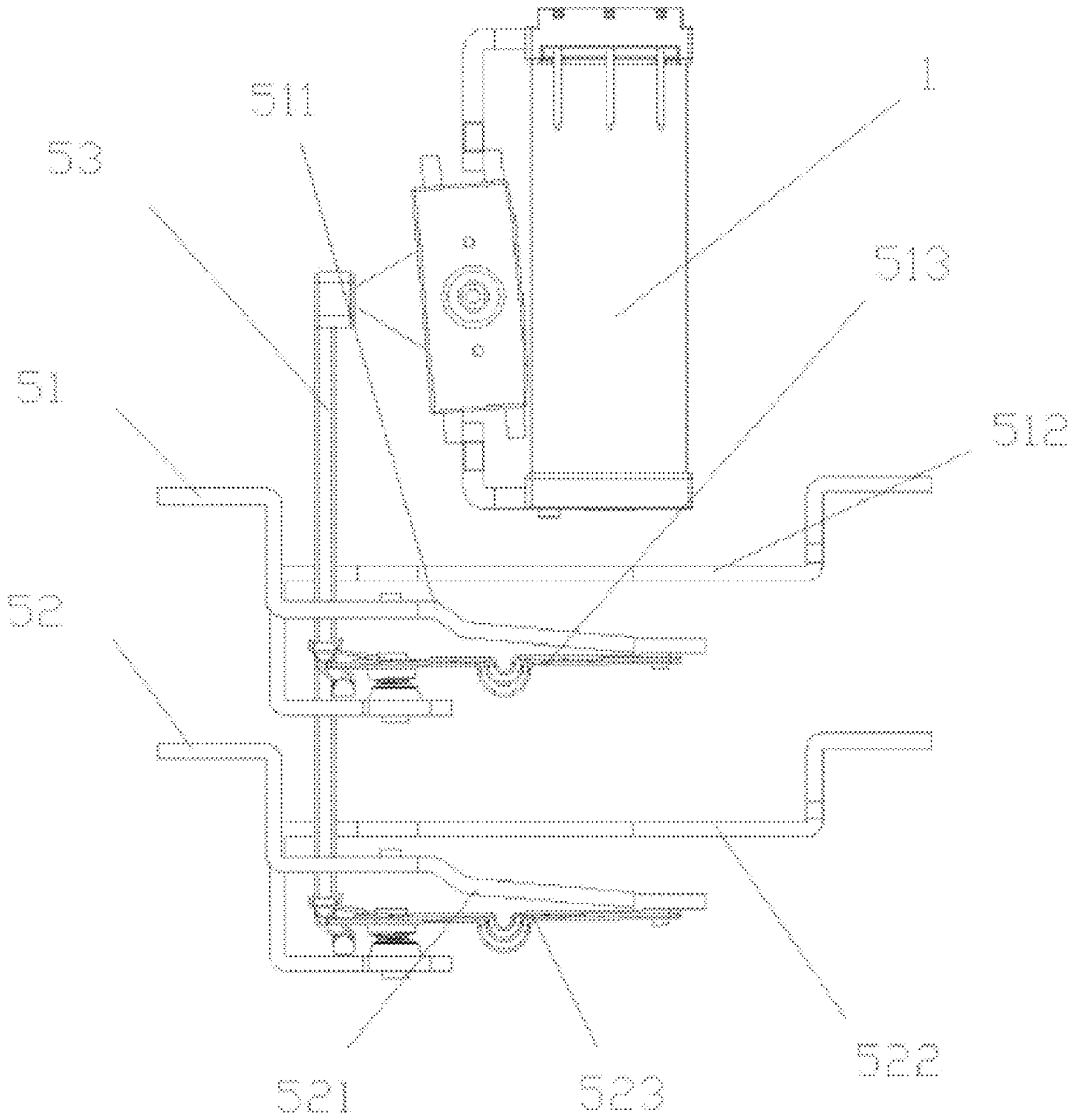
FIG. 16 is a schematic view of the structure of Embodiment 6 of the present invention (with contacts closed).
Figure 17:
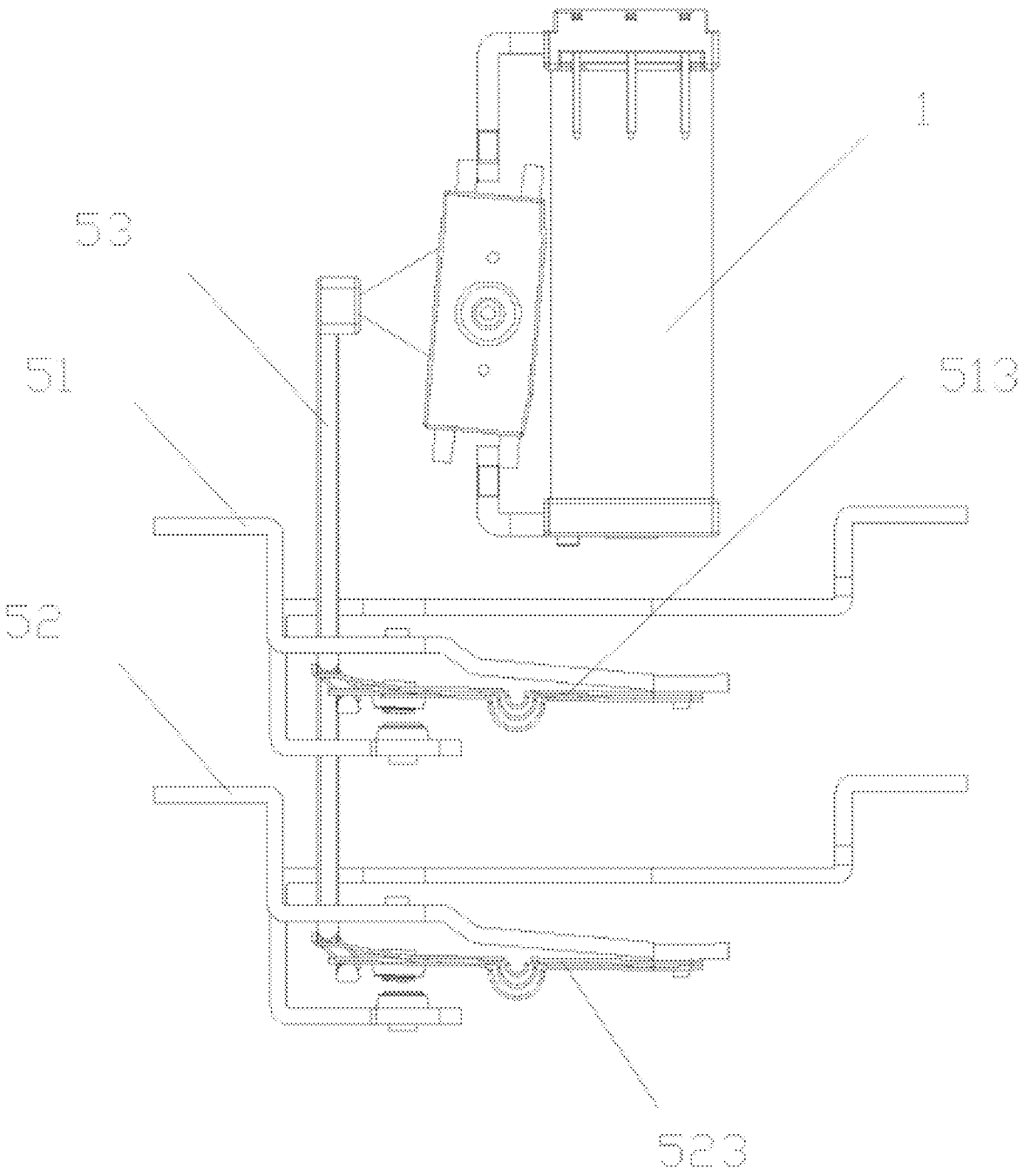
FIG. 17 is a schematic view of the structure of Embodiment 6 of the present invention (with contacts disconnected).

Referring to FIG. 16 to FIG. 17, a magnetic latching relay capable of resisting the short-circuit current according to Embodiment 6 of the present invention differs from the above Embodiment 1 in that the contact system is two systems, that is, a contact system 51 and a contact system 52, including corresponding two groups of movable spring portion and static spring portion cooperating with each other. Another end of each of the movable spring leads of the two contact systems, that is, the movable spring lead 511 and the movable spring lead 521 extends from a side of the magnetic latching relay, and another end of each of the static spring leads of the two contact systems, that is, the static spring lead 512 and the static spring lead 522 extends from another side of the magnetic latching relay.

In this embodiment, the axis of the coil of the magnetic circuit system is substantially perpendicular to the movable spring 513 and movable spring 523 of the contact system, and the cooperating positions of the movable and static contacts of the two contact systems are aligned with respect to the magnetic circuit system 1. The magnetic circuit system 1 is disposed outside the two contact systems, and the magnetic circuit system 1 cooperates with the two movable springs, that is, the movable spring 513 and the movable spring 523, by a pushing mechanism 53.

In this embodiment, there are two groups of contact circuits, which are two groups of normally open or normally closed contact circuits.

Embodiment 7

Figure 18:
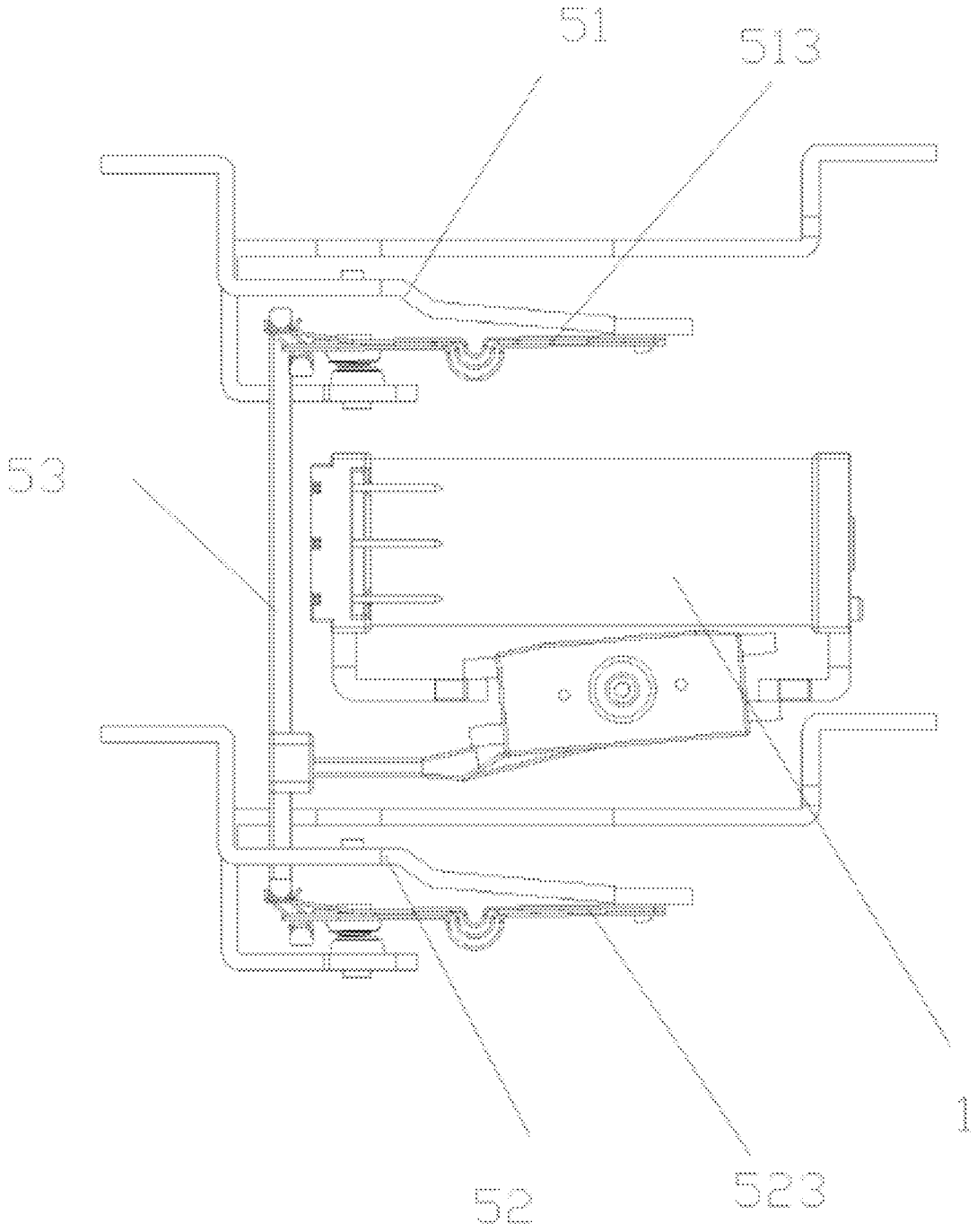
FIG. 18 is a schematic view of the structure of Embodiment 7 of the present invention (with contacts closed).
Figure 19:
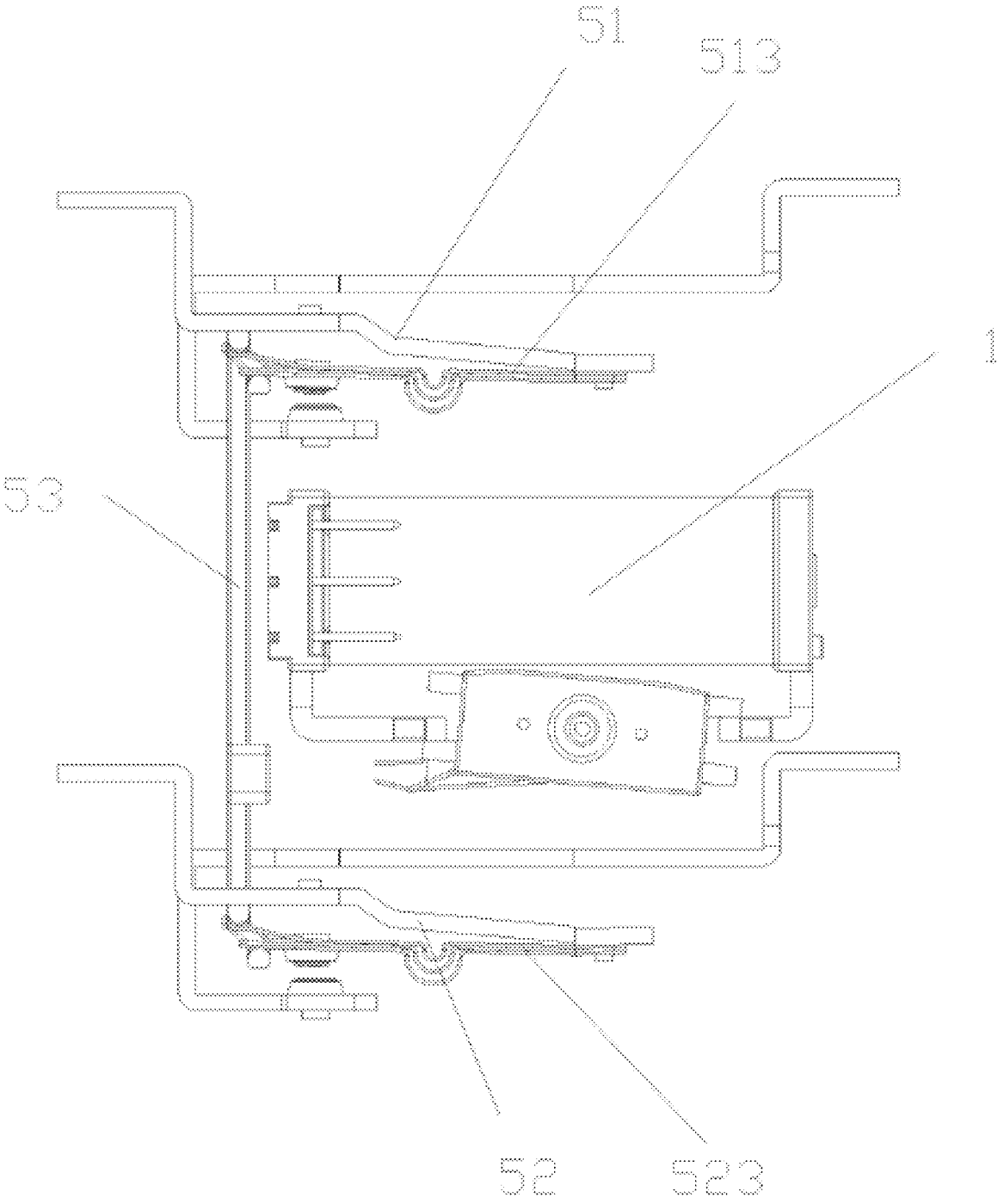
FIG. 19 is a schematic view of the structure of Embodiment 7 of the present invention (with contacts disconnected).

Referring to FIG. 18 to FIG. 19, a magnetic latching relay capable of resisting the short-circuit current according to Embodiment 7 of the present invention differs from the above Embodiment 6 in that the axis of the coil of the magnetic circuit system 1 is substantially parallel to the movable spring 513 and movable spring 523 of the contact systems. The cooperating positions of the movable and static contacts of the two contact systems are aligned with respect to the magnetic circuit system 1. The magnetic circuit system 1 is disposed between the two contact systems, that is, the contact system 51 and the contact system 52, and the magnetic circuit system 1 cooperates with the two movable springs, that is, the movable spring 513 and the movable spring 523, by a pushing mechanism 53.

In this embodiment, there are two groups of contact circuits, which are two groups of normally open or normally closed contact circuits.

Embodiment 8

Figure 20:
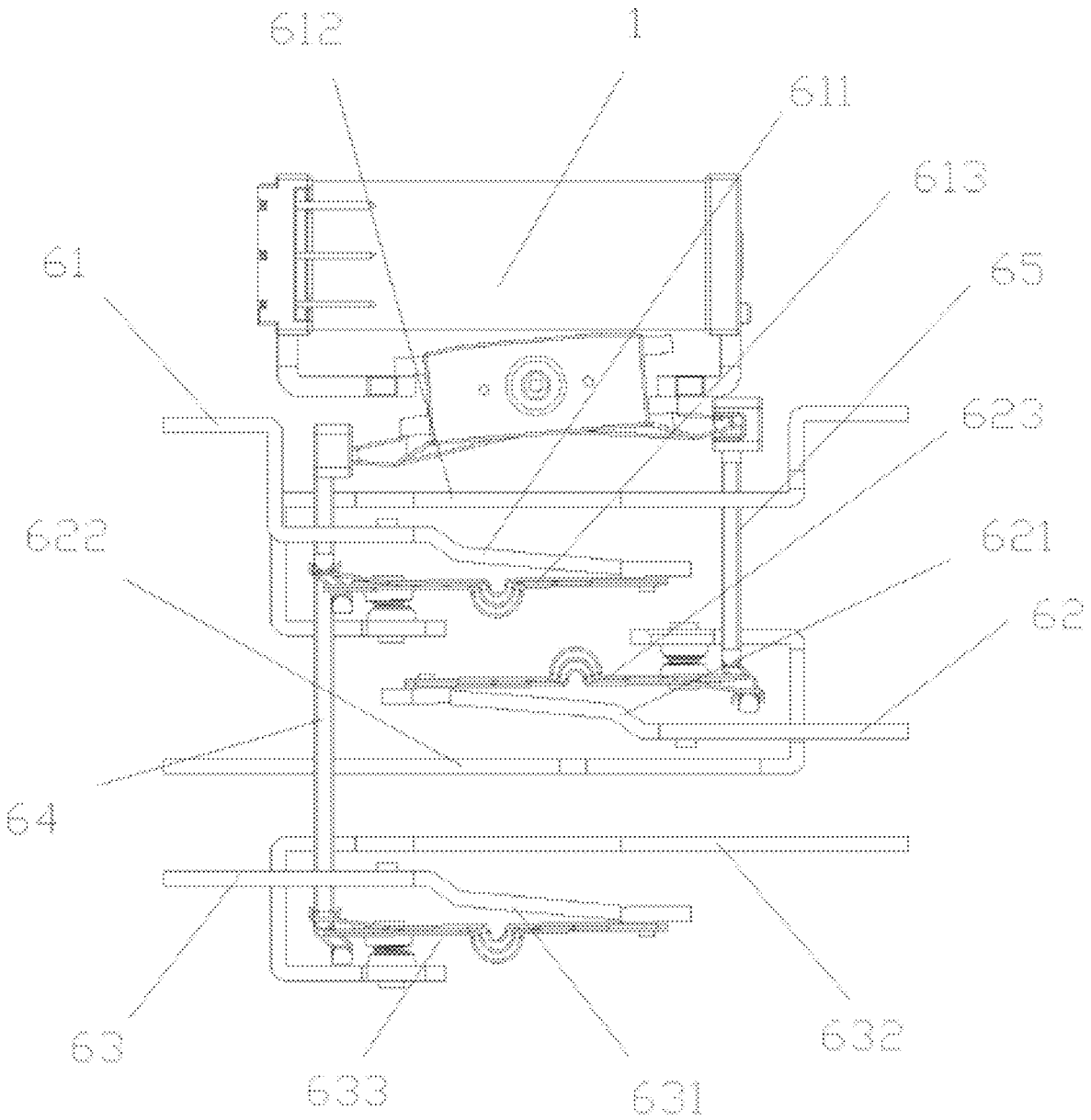
FIG. 20 is a schematic view of the structure of Embodiment 8 of the present invention (with contacts closed).
Figure 21:
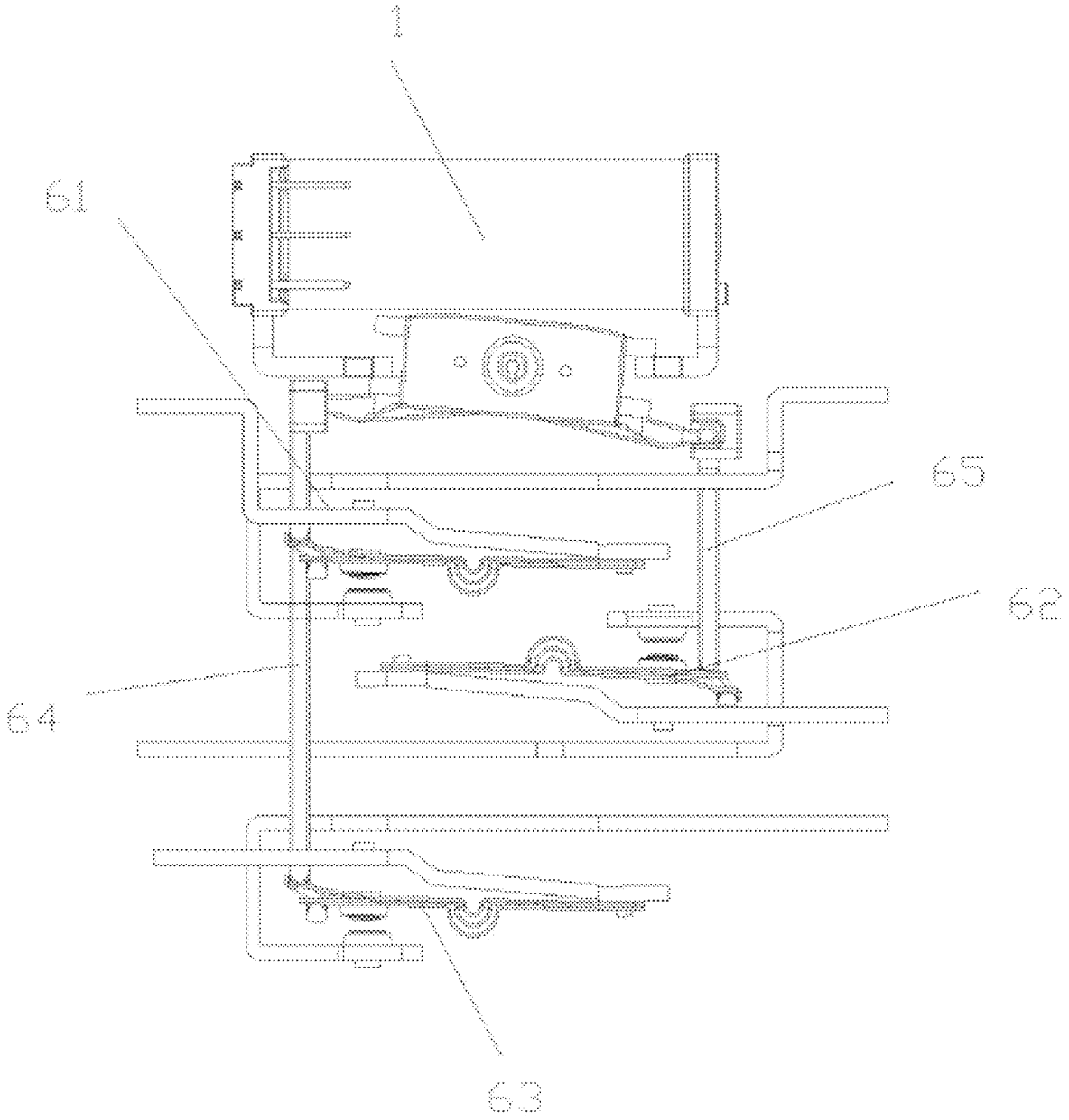
FIG. 21 is a schematic view of the structure of Embodiment 8 of the present invention (with contacts disconnected).

Referring to FIG. 20 to FIG. 21, a magnetic latching relay capable of resisting the short-circuit current according to Embodiment 8 of the present invention differs from the above Embodiment 1 in that the contact system comprises three contact systems, i.e., contact system 61, contact system 62, and contact system 63, including three groups of movable spring portions and static spring portions cooperated with each other. Another end of the movable spring lead 611 of the first contact system 61 extends from a side of the magnetic latching relay, and another end of the static spring lead 612 extends from another side of the magnetic latching relay. Another end of the movable spring lead 621 of the second contact system 62 extends from another side of the magnetic latching relay, and another end of the static spring lead 622 extends from a side of the magnetic latching relay. Another end of the movable spring lead 631 of the third contact system 63 extends from a side of the magnetic latching relay, and another end of the static spring lead 632 extends from another side of the magnetic latching relay.

In the present embodiment, the axis of the coil of the magnetic circuit system 1 is substantially parallel to the movable springs of the contact systems, that is, the movable spring 613, the movable spring 623, and the movable spring 633. The cooperation positions of the movable and static contacts of the first contact system 61 and the second contact system 62 are misaligned with respect to the magnetic circuit system 1. The cooperation positions of the movable and static contacts of the first contact system 61 and the third contact system 63 are aligned with respect to the magnetic circuit system 1. The magnetic circuit system 1 operates with the corresponding movable springs by two pushing mechanisms, respectively, that is, the magnetic circuit system 1 cooperates with the movable spring 613 and the movable spring 633 by a pushing mechanism 64, and the magnetic circuit system 1 cooperates with the movable spring 623 by a pushing mechanism 65.

In this embodiment, there are three groups of contact circuits, which are three groups of normally open or normally closed contact circuits.

Embodiment 9

Figure 22:
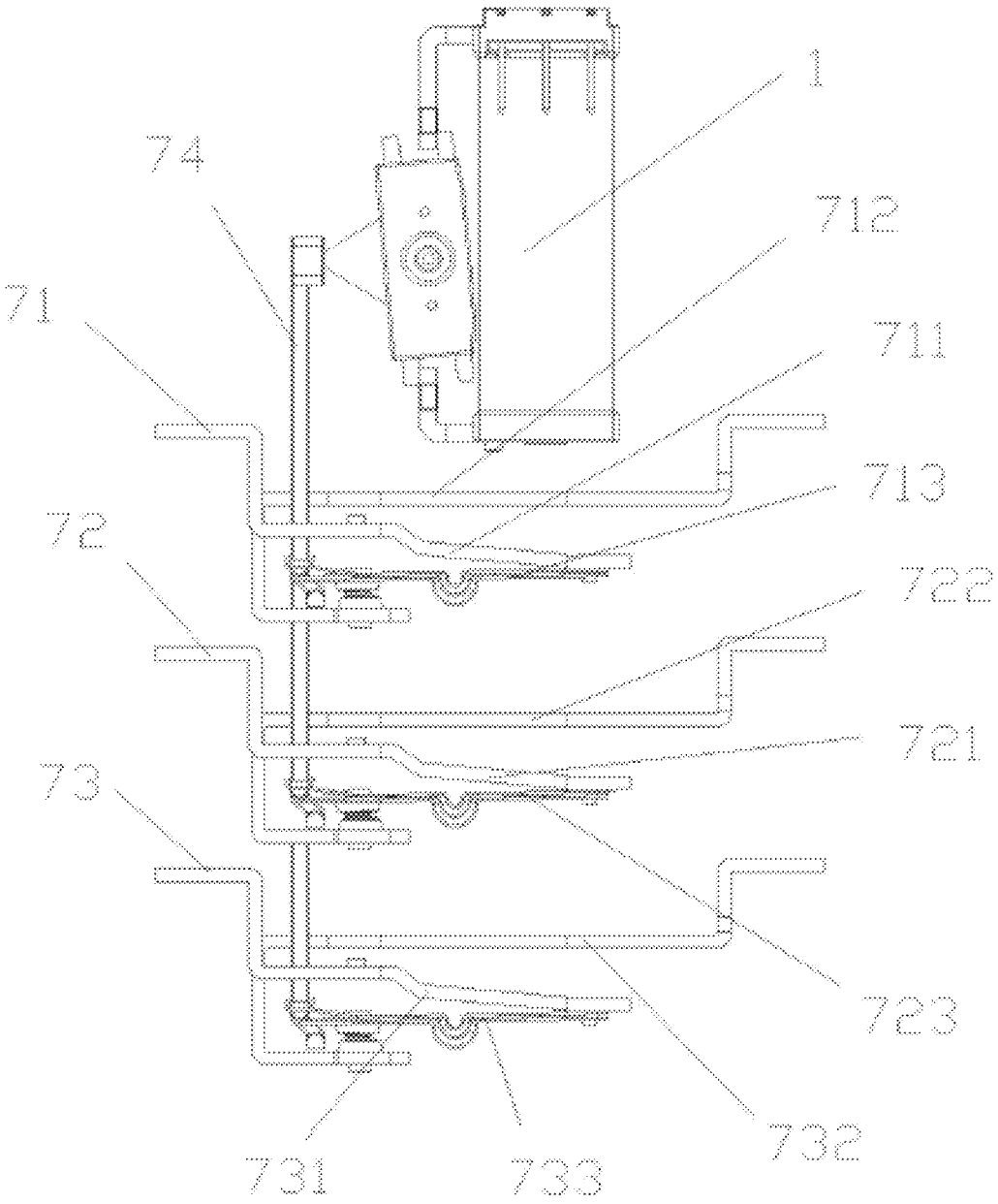
FIG. 22 is a schematic view of the structure of Embodiment 9 of the present invention (with contacts closed).
Figure 23:
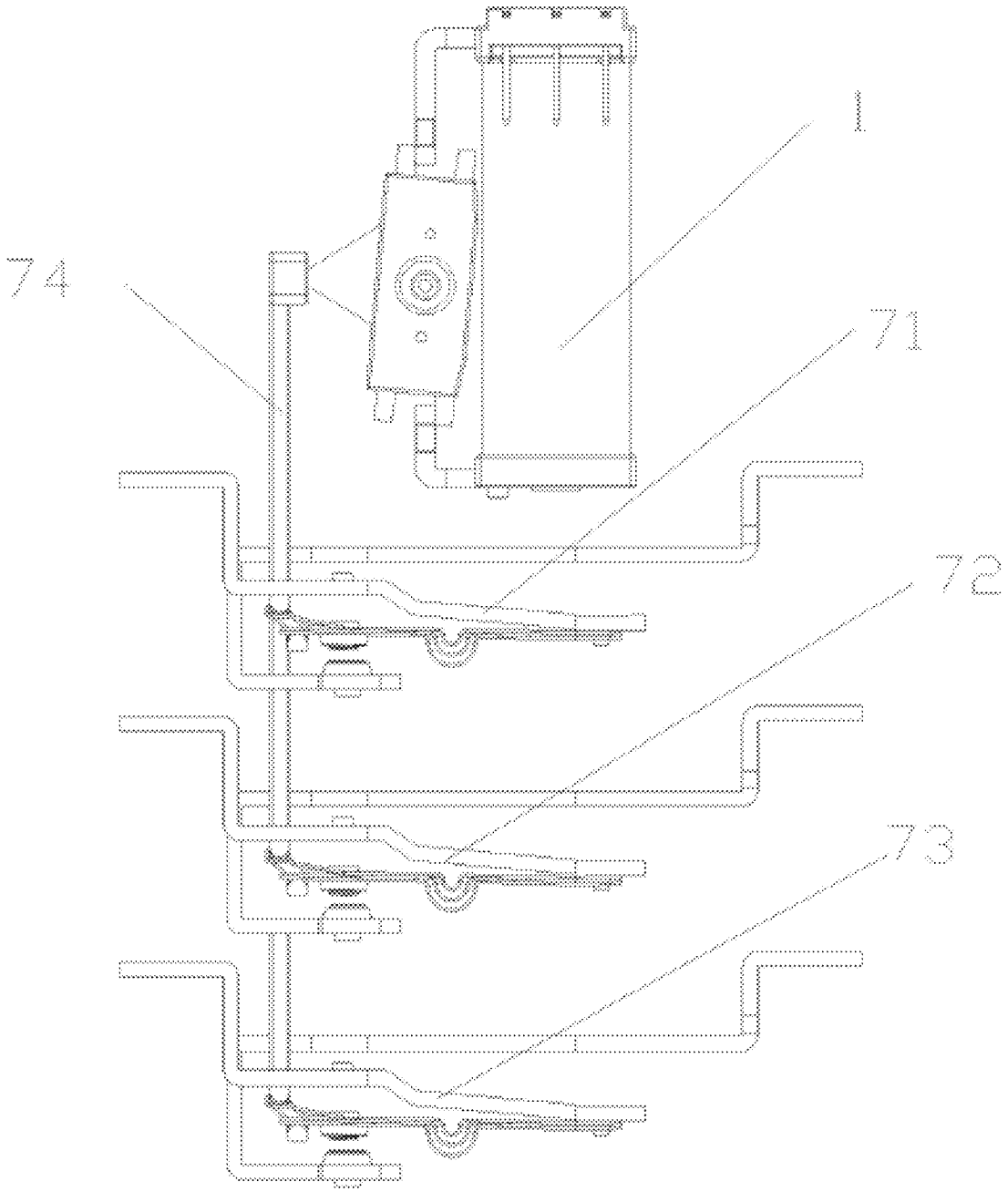
FIG. 23 is a schematic view of the structure of Embodiment 9 of the present invention (with contacts disconnected).

Referring to FIG. 22 to FIG. 23, a magnetic latching relay capable of resisting the short-circuit current according to Embodiment 8 of the present invention differs from the above Embodiment 1 in that the contact system is three systems, namely, a contact system 71, a contact system 72, and a contact system 73, including three groups of movable spring portions and static spring portions cooperating with each other. Another end of the movable spring lead of each contact system, that is, the movable spring lead 711, the movable spring lead 721 and the movable spring lead 731 extend from a side of the magnetic latching relay, and another end of the static spring lead of each contact system, that is, the static spring lead 712, the static spring lead 722, and the static spring lead 732 extends from another side of the magnetic latching relay.

In the present embodiment, the axis of the coil of the magnetic circuit system 1 is substantially perpendicular to the movable springs 713, the movable spring 723, and the movable spring 733 of the contact system. The cooperation positions of the movable and static contacts of the three contact systems are aligned with respect to the magnetic circuit system 1. The magnetic circuit system 1 is disposed outside the three contact systems, and the magnetic circuit system 1 cooperates with three movable springs, that is, the movable spring 713, the movable spring 723, and the movable spring 733 by a pushing mechanism 74.

In this embodiment, there are three groups of contact circuits, which are three groups of normally open or normally closed contact circuits.

Embodiment 10

Figure 24:
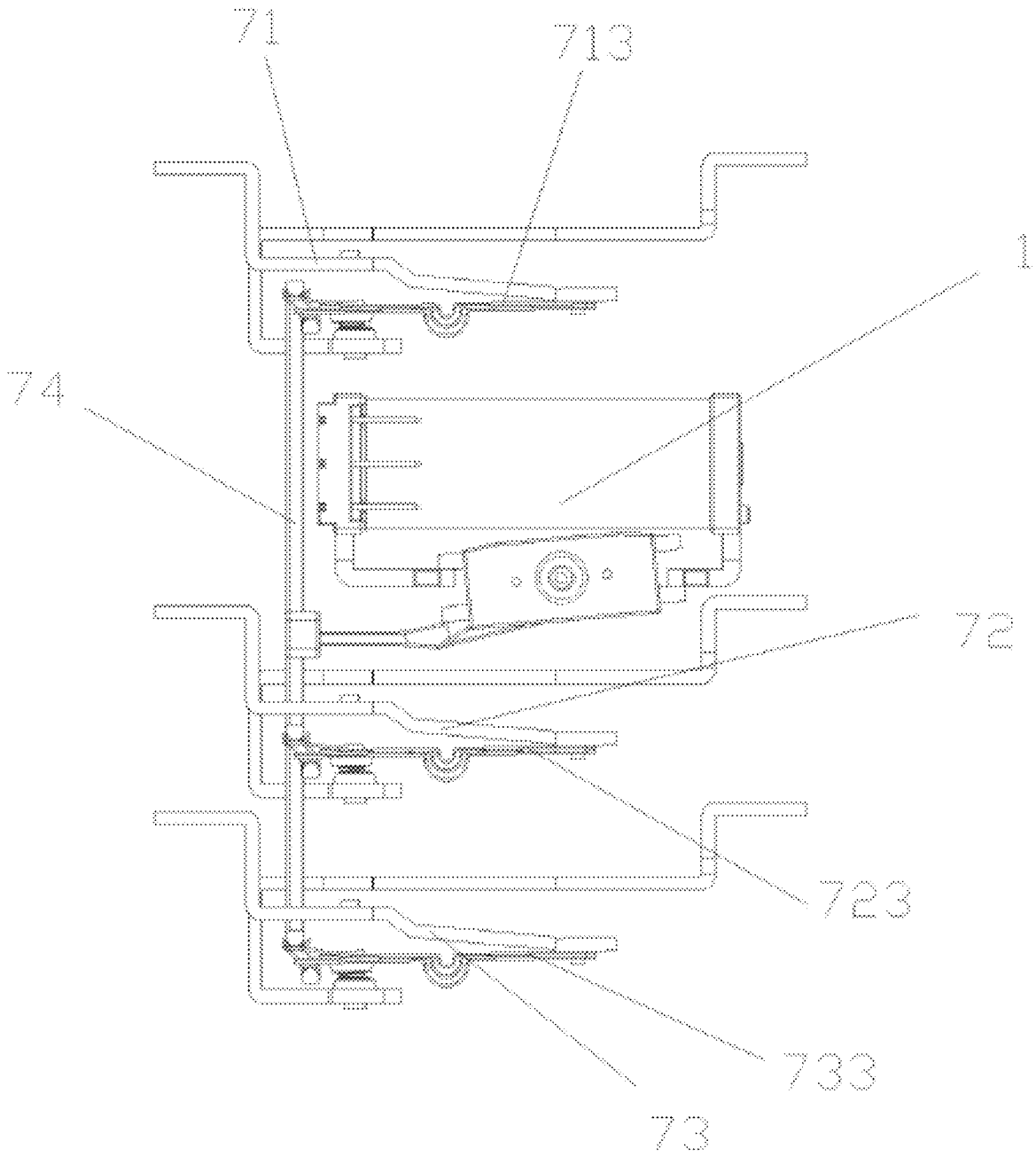
FIG. 24 is a schematic view of the structure of Embodiment 10 of the present invention (with contacts closed).
Figure 25:
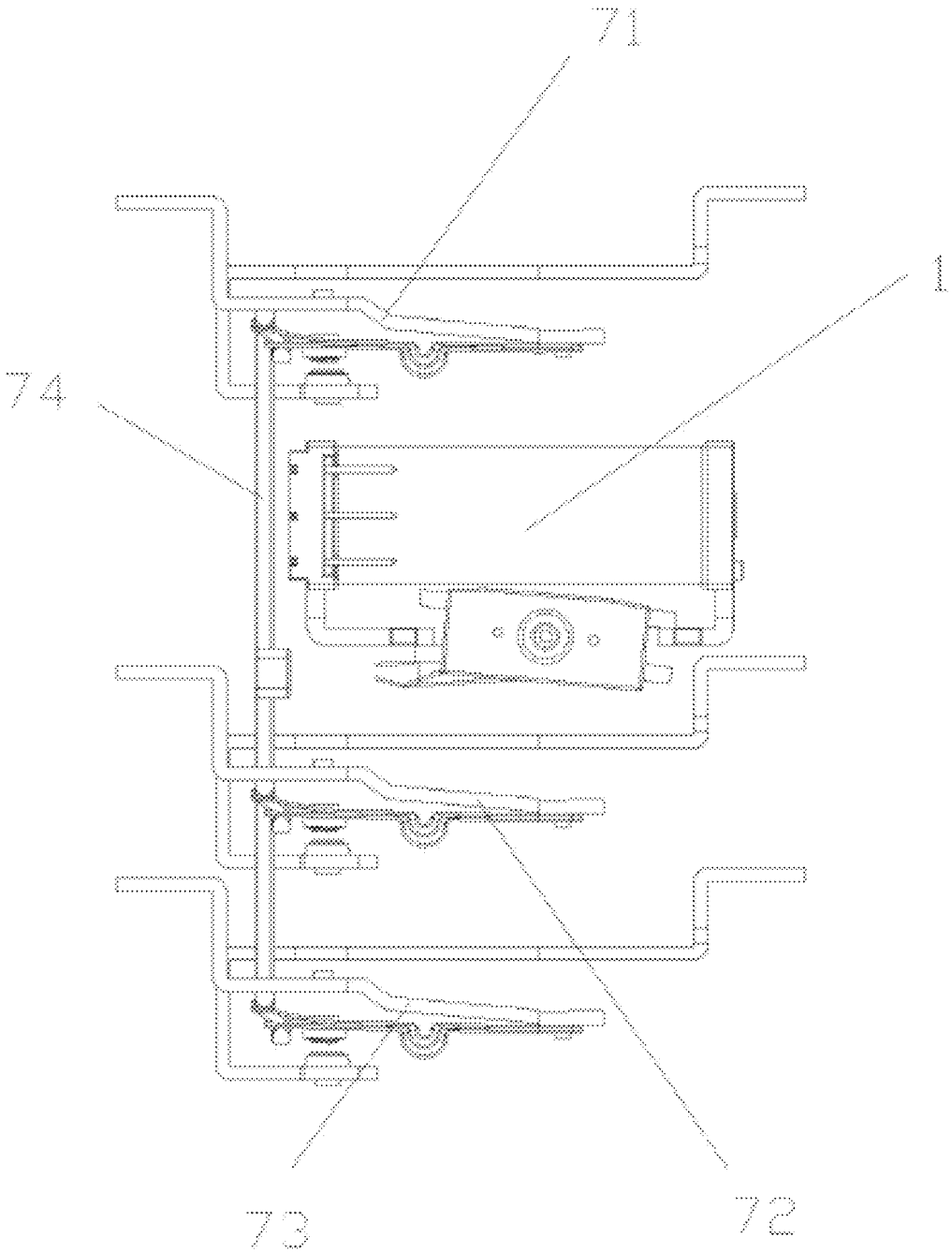
FIG. 25 is a schematic view of the structure of Embodiment 10 of the present invention (with contacts disconnected).
Figure 26:
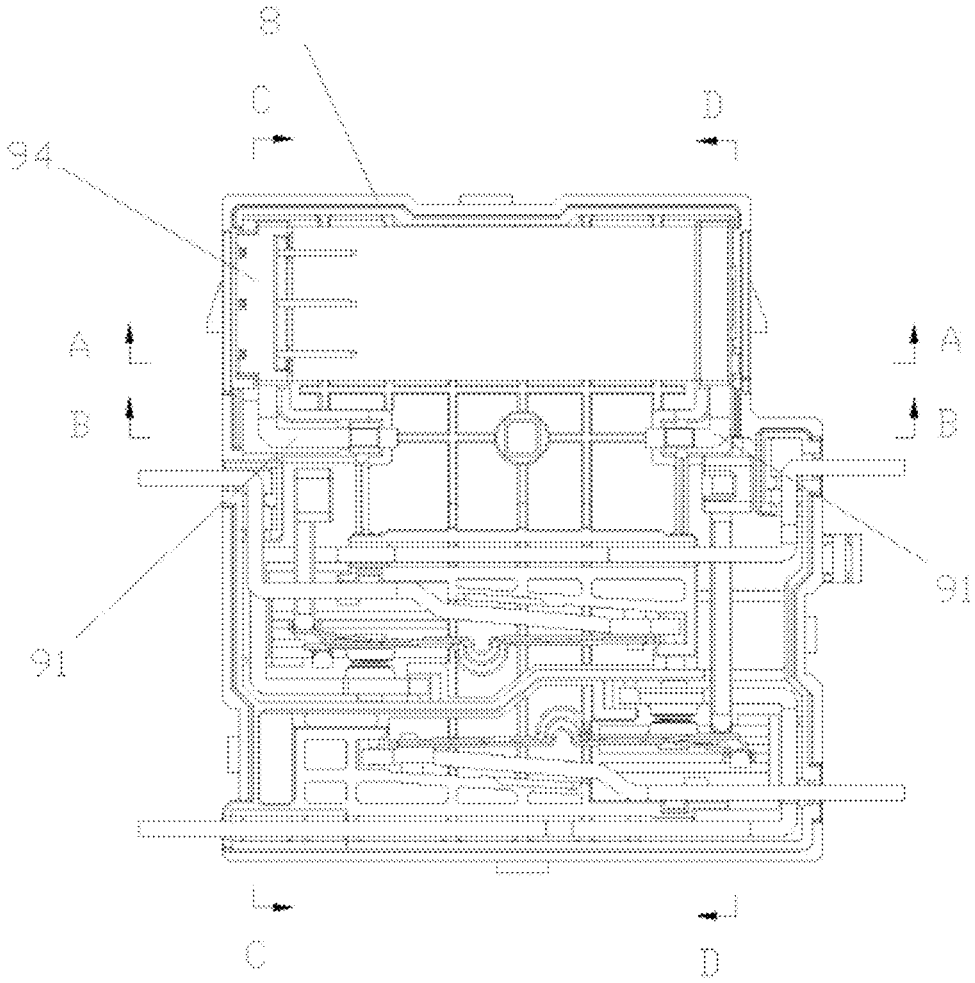
FIG. 26 is a schematic view of the structure of Embodiment 1 for magnetic circuit positioning of the present invention.
Figure 27:
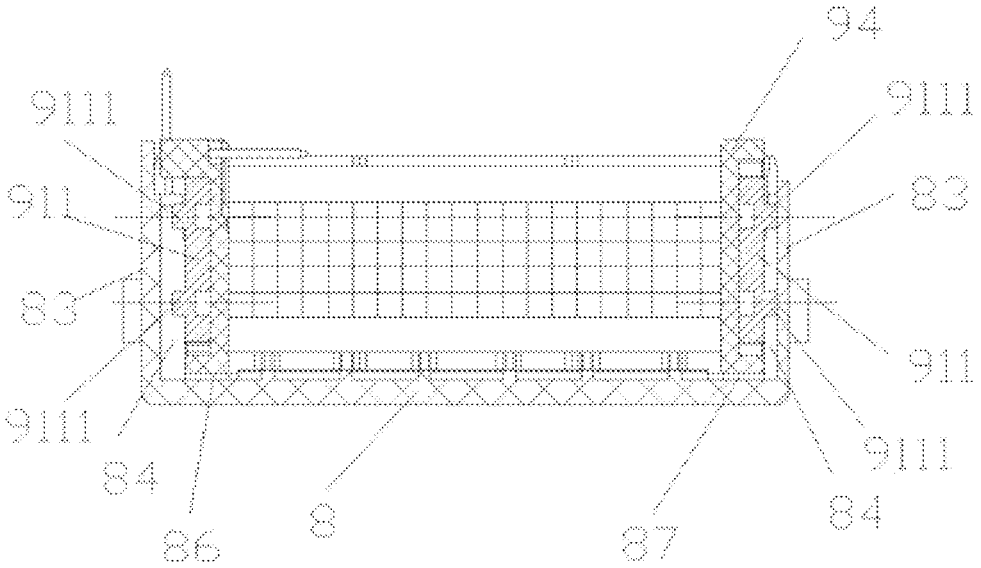
FIG. 27 is a cross-sectional view taken along line A-A of FIG. 26.
Figure 28:
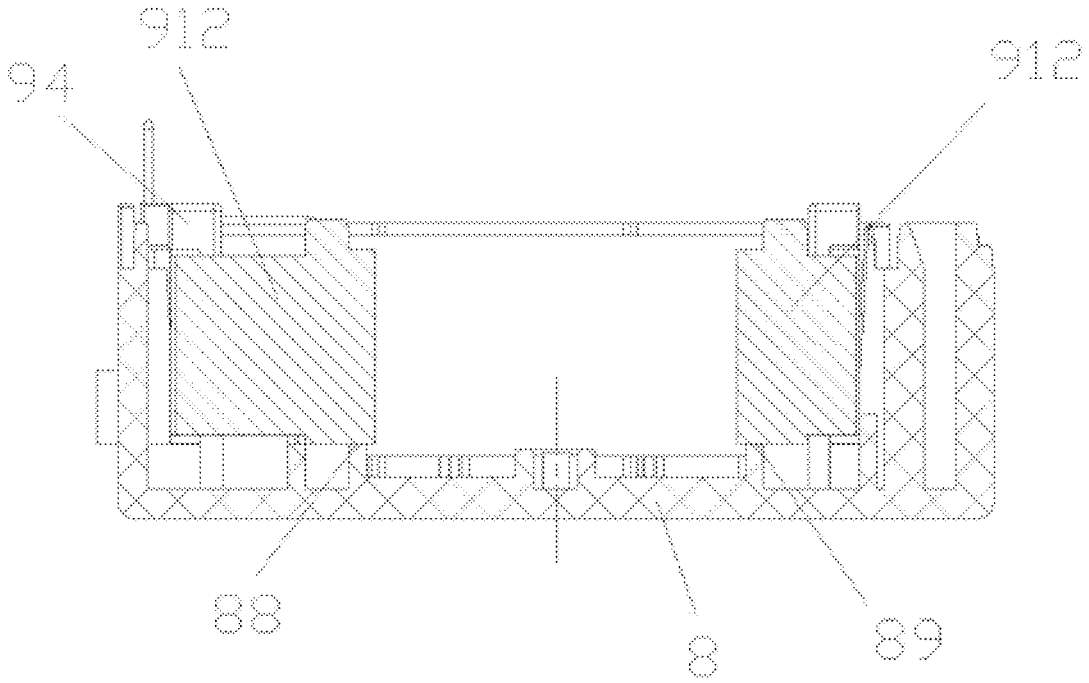
FIG. 28 is a cross-sectional view taken along line B-B of FIG. 26.
Figure 29:
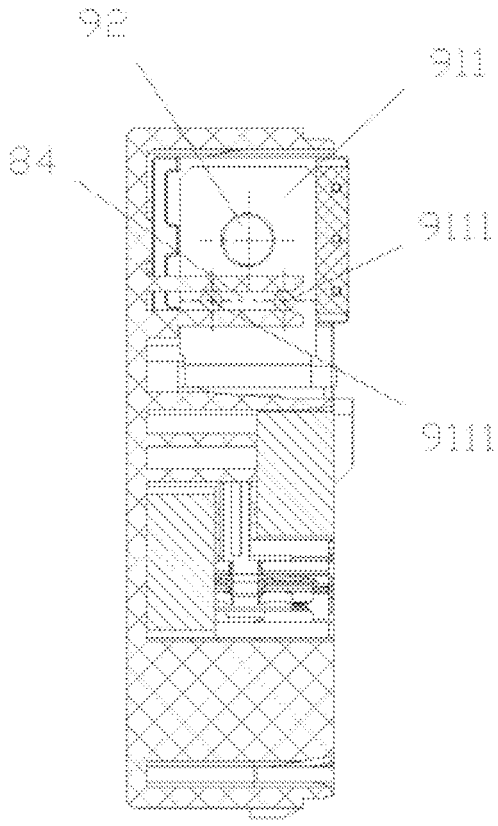
FIG. 29 is a cross-sectional view taken along line C-C of FIG. 26.
Figure 30:
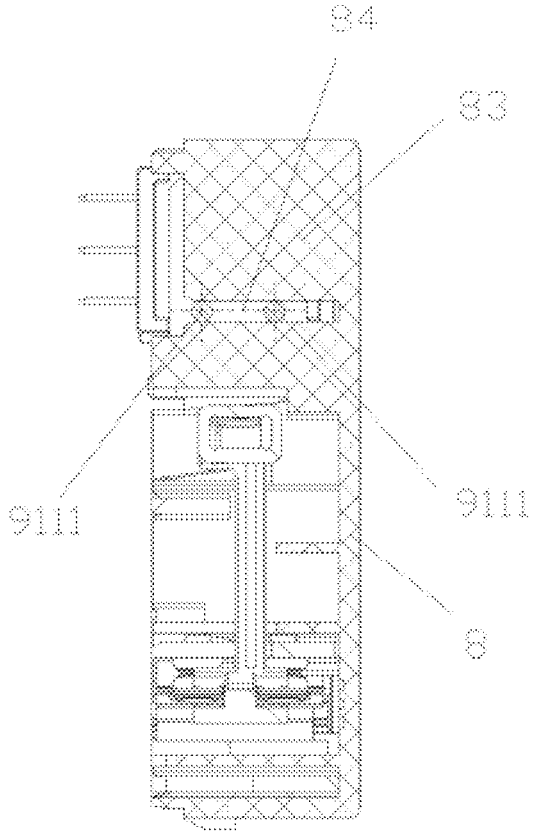
FIG. 30 is a cross-sectional view taken along line D-D of FIG. 26.
Figure 31:
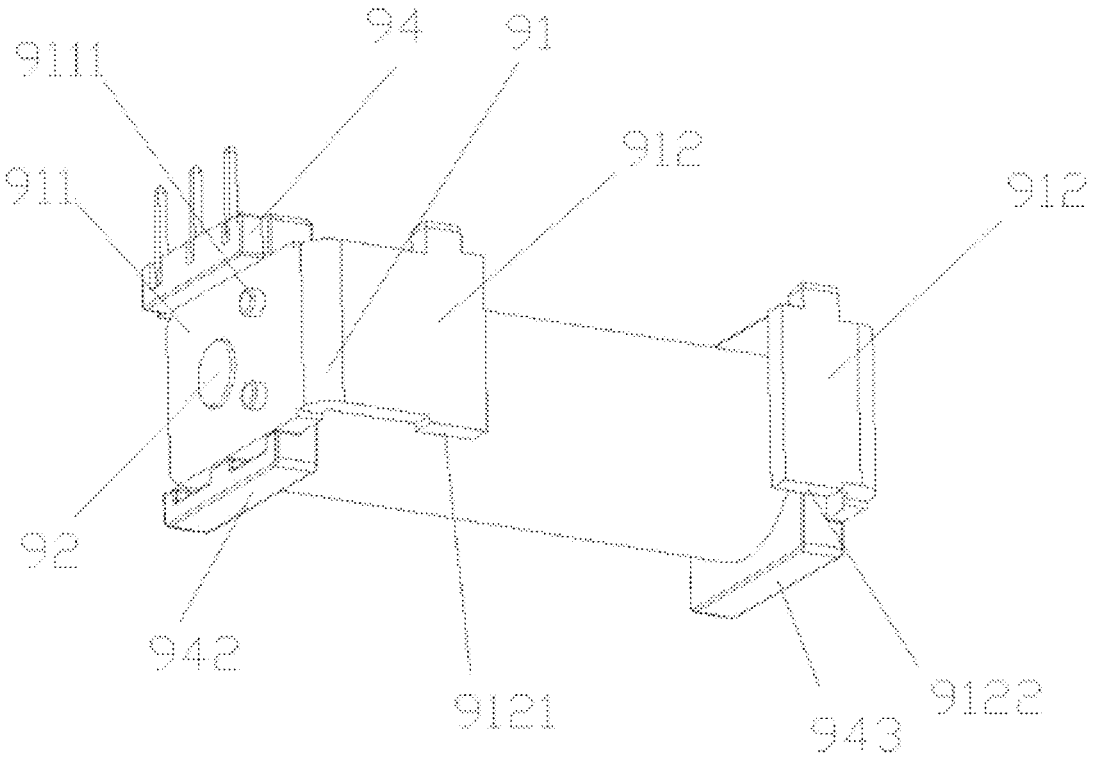
FIG. 31 is a schematic view of the structure of the magnetic circuit portion (without an armature) of Embodiment 1 for magnetic circuit positioning of the present invention.
Figure 32:
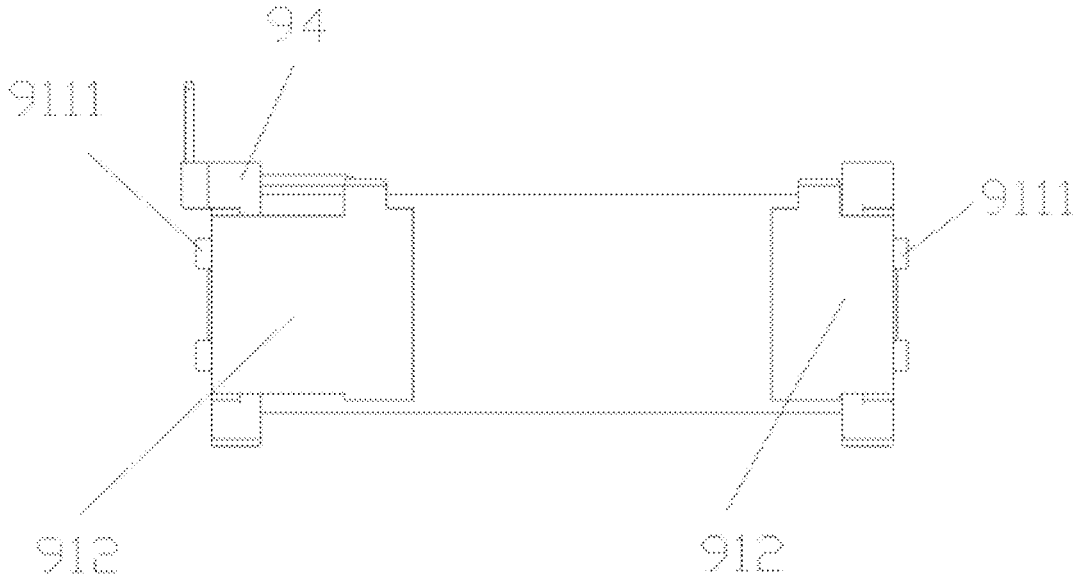
FIG. 32 is a front view of the structure of the magnetic circuit portion (without an armature) of Embodiment 1 for magnetic circuit positioning of the present invention.
Figure 33:
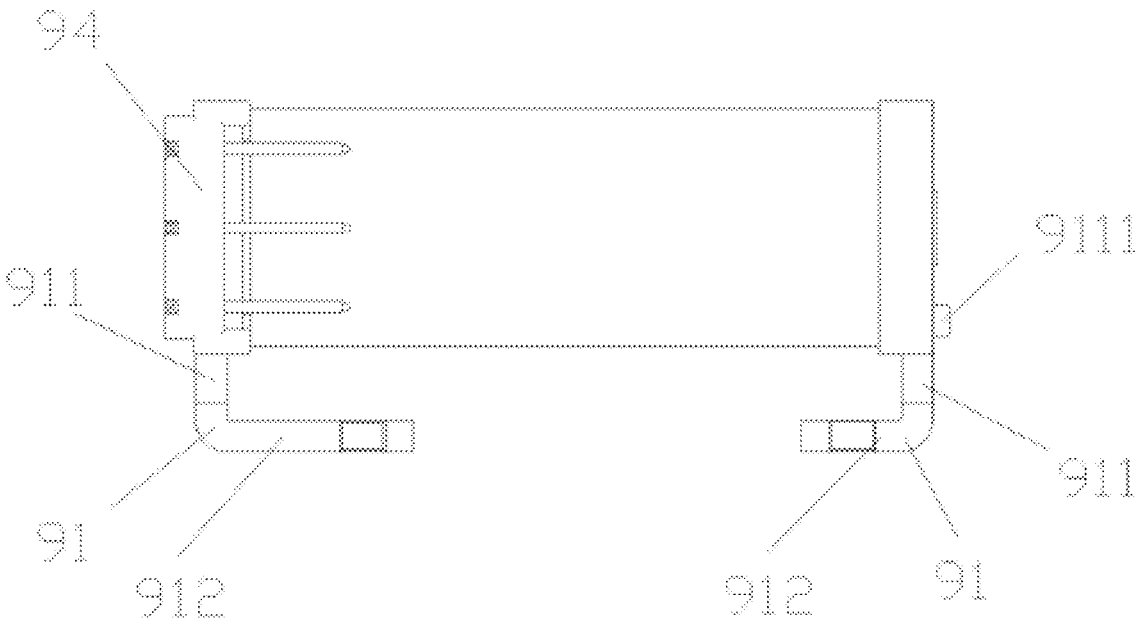
FIG. 33 is a bottom view of the structure of the magnetic circuit portion (without an armature) of Embodiment 1 for magnetic circuit positioning of the present invention.
Figure 34:
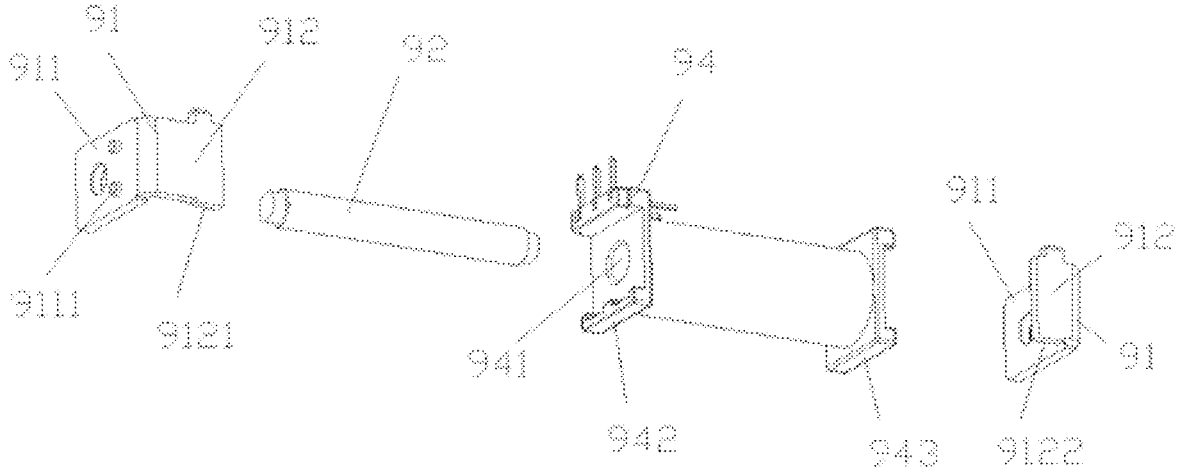
FIG. 34 is an exploded view of the structure of the magnetic circuit portion (without an armature) of Embodiment 1 for magnetic circuit positioning of the present invention.
Figure 35:
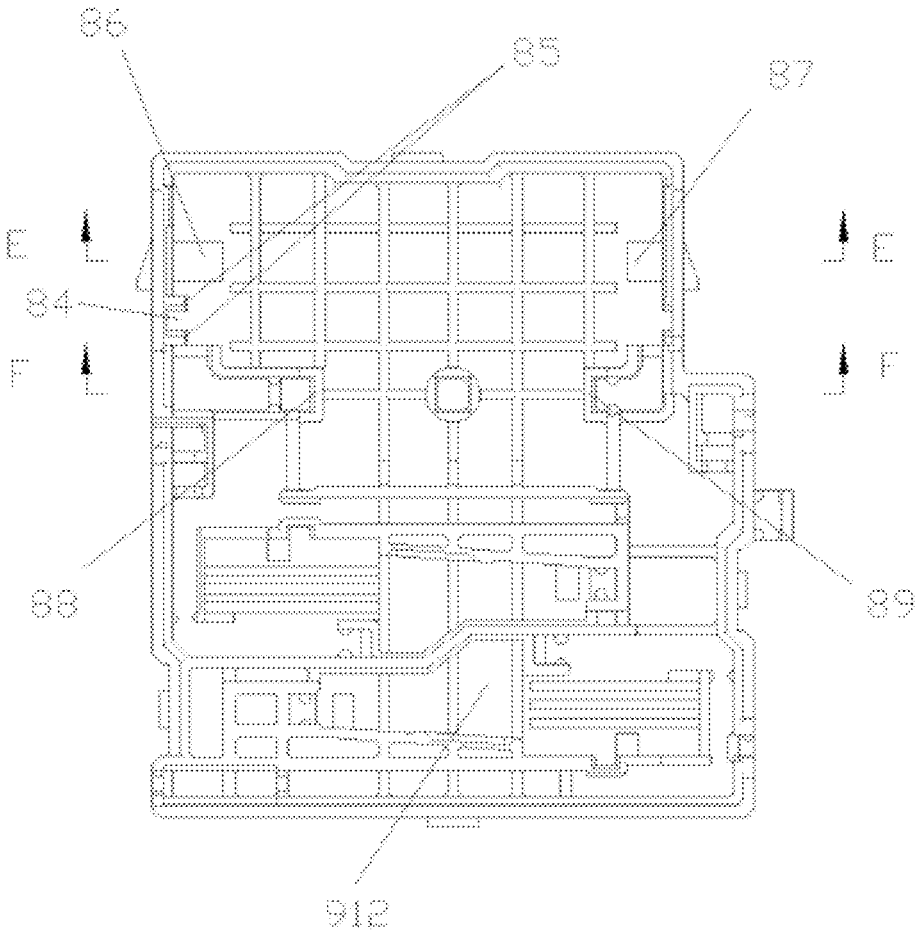
FIG. 35 is a schematic view of the structure of the base of Embodiment 1 for magnetic circuit positioning of the present invention.
Figure 36:
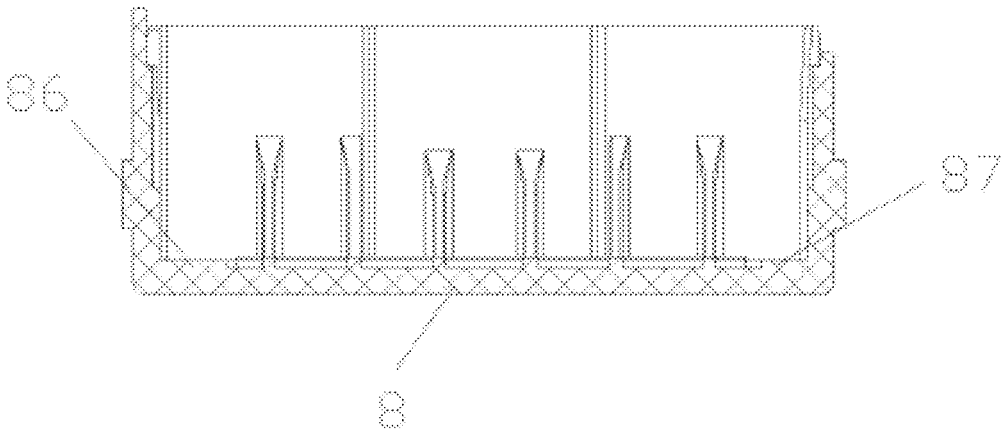
FIG. 36 is a cross-sectional view taken along line E-E of FIG. 35.
Figure 37:
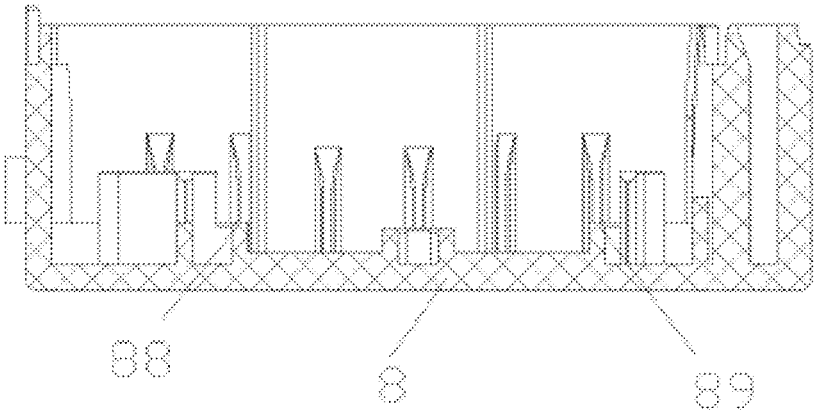
FIG. 37 is a cross-sectional view taken along line F-F of FIG. 35.
Figure 38:
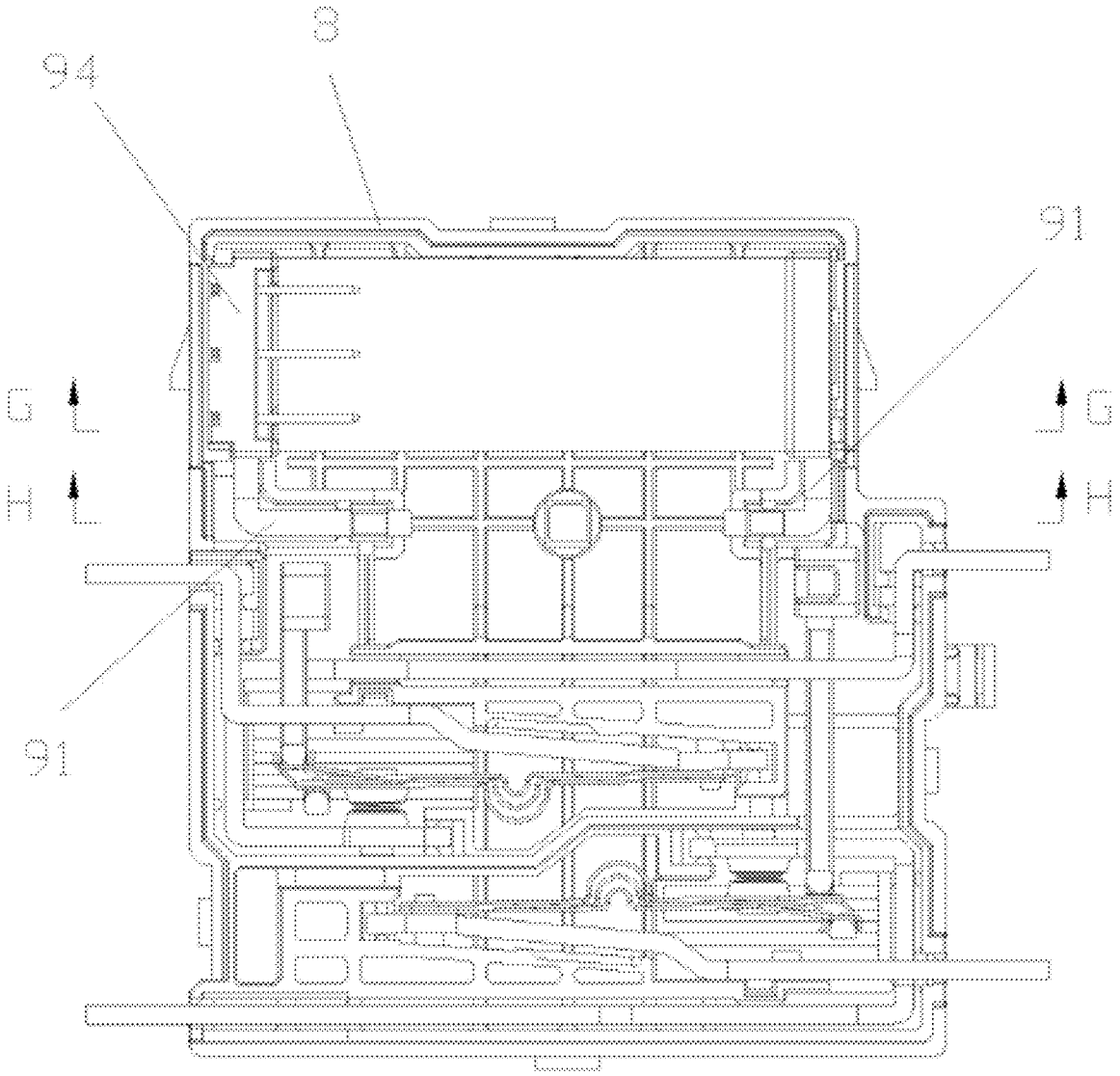
FIG. 38 is a schematic view of the structure of Embodiment 2 for magnetic circuit positioning of the present invention.
Figure 39:
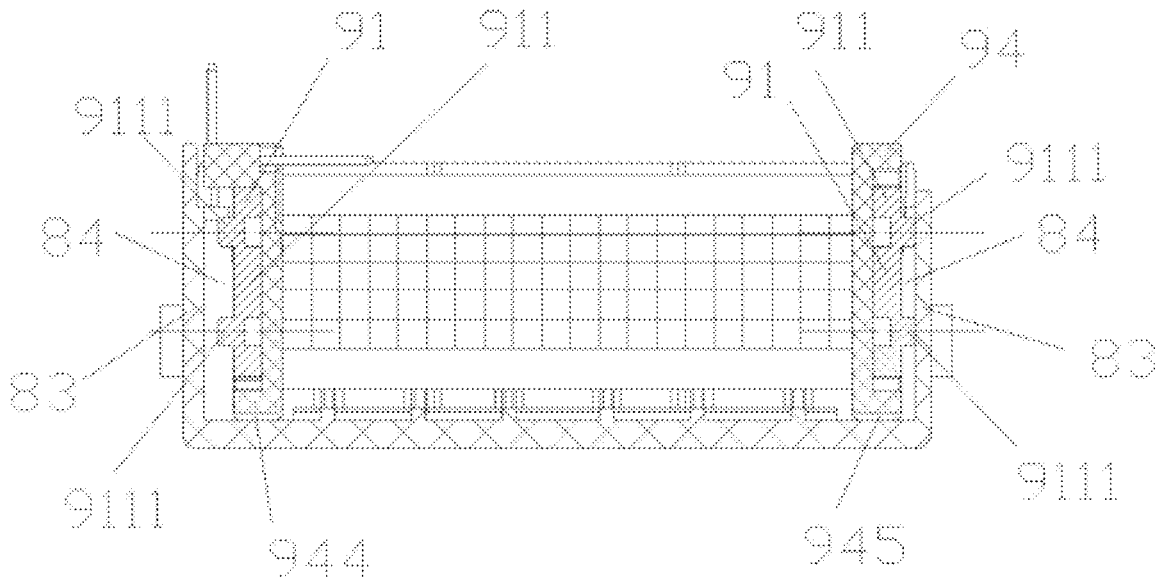
FIG. 39 is a cross-sectional view taken along line G-G of FIG. 38.
Figure 40:
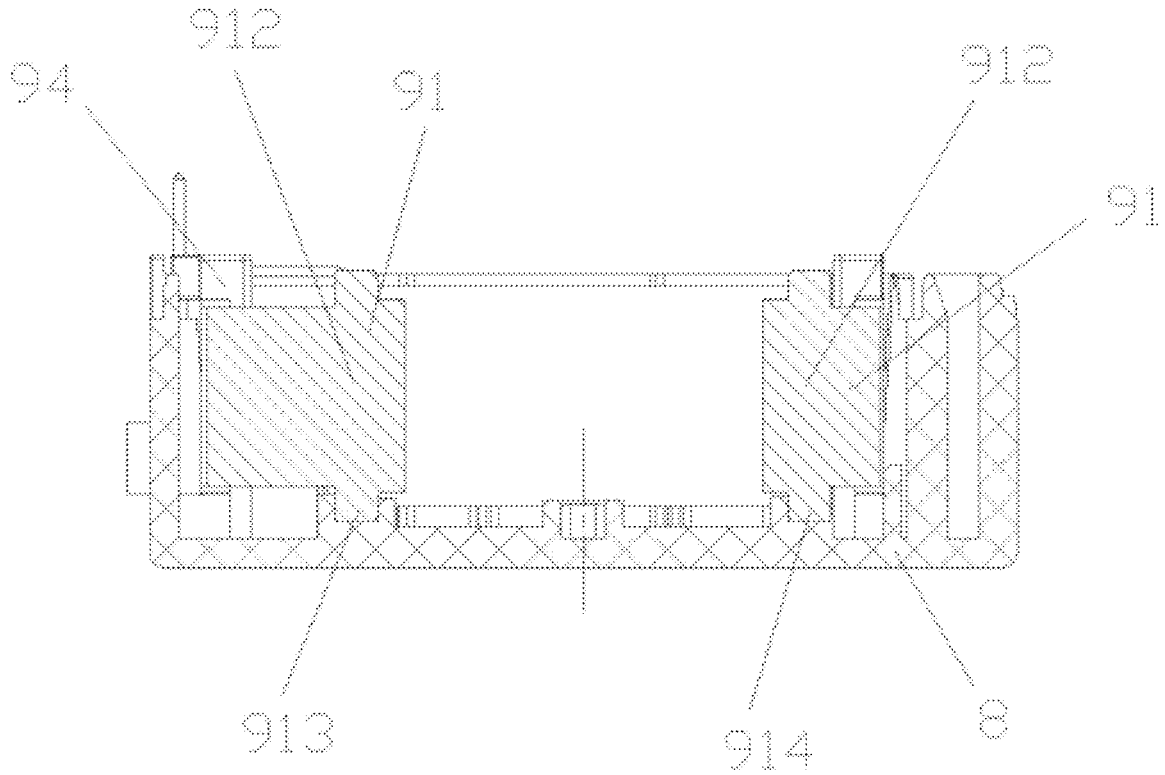
FIG. 40 is a cross-sectional view taken along line H-H of FIG. 38.
Figure 41:
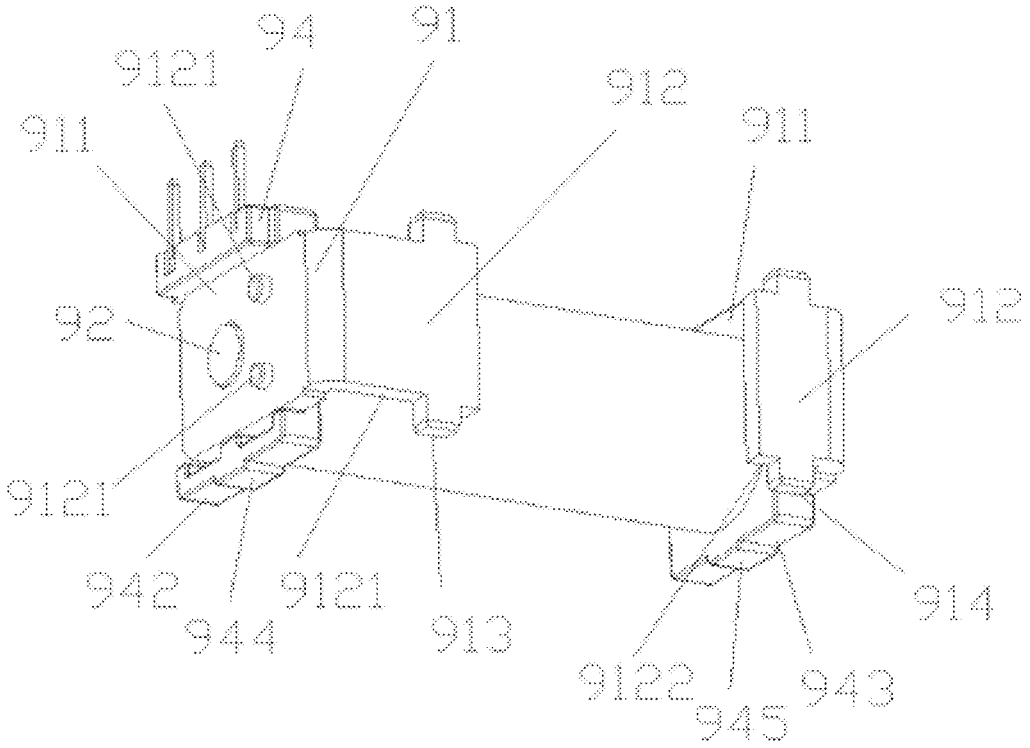
FIG. 41 is a schematic view of the structure of the magnetic circuit portion (without an armature) of Embodiment 2 for magnetic circuit positioning of the present invention.
Figure 42:
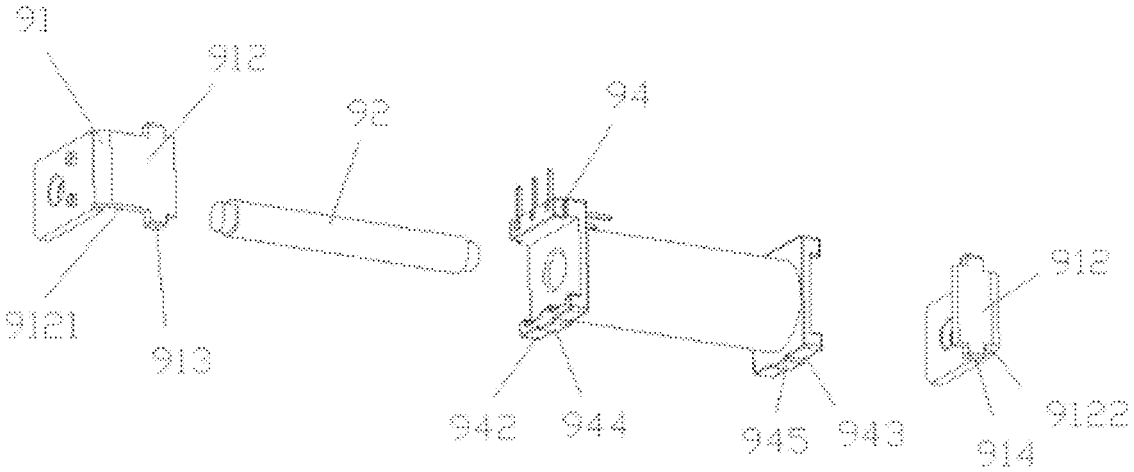
FIG. 42 is an exploded view of the structure of the magnetic circuit portion (without an armature) of Embodiment 2 for magnetic circuit positioning of the present invention.
Figure 43:
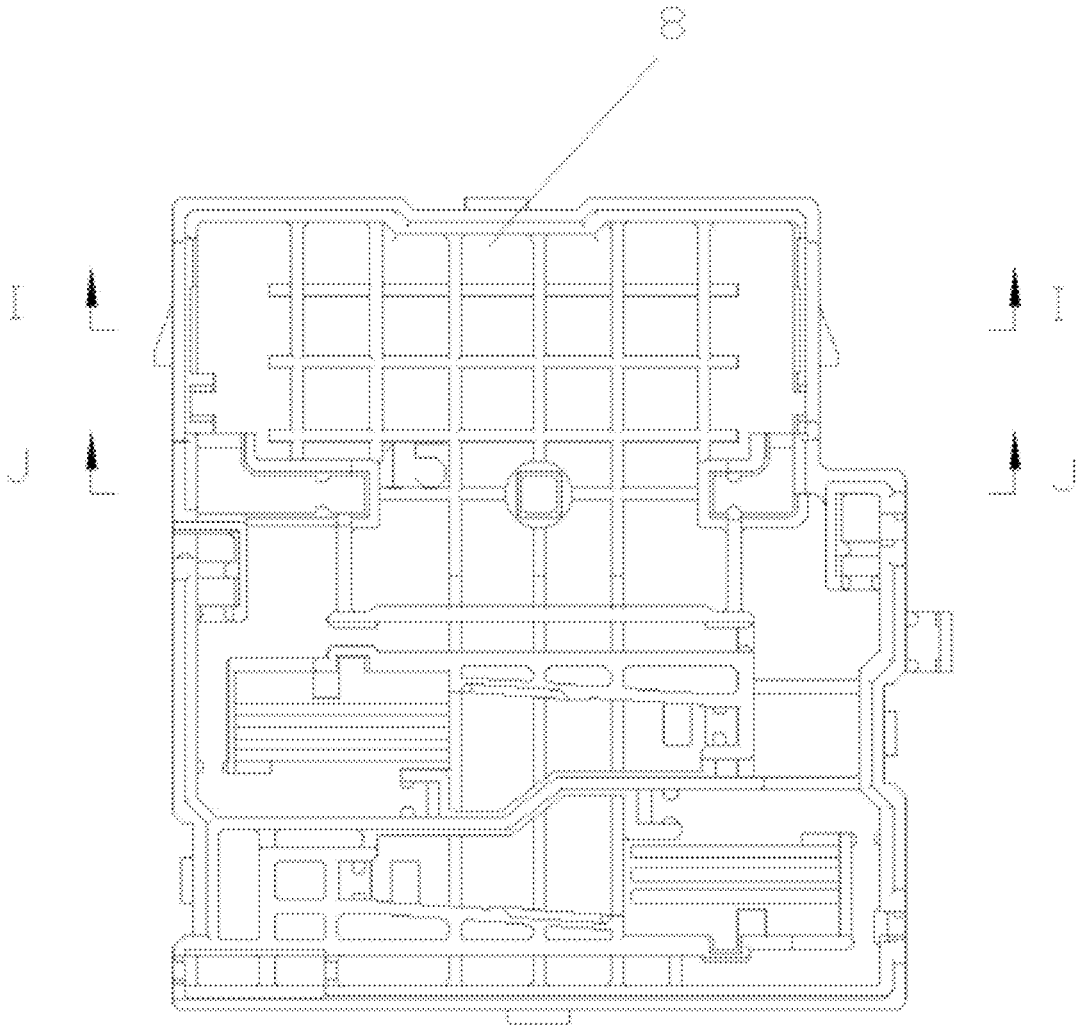
FIG. 43 is a schematic view of the structure of the base of Embodiment 2 for magnetic circuit positioning of the present invention.
Figure 44:
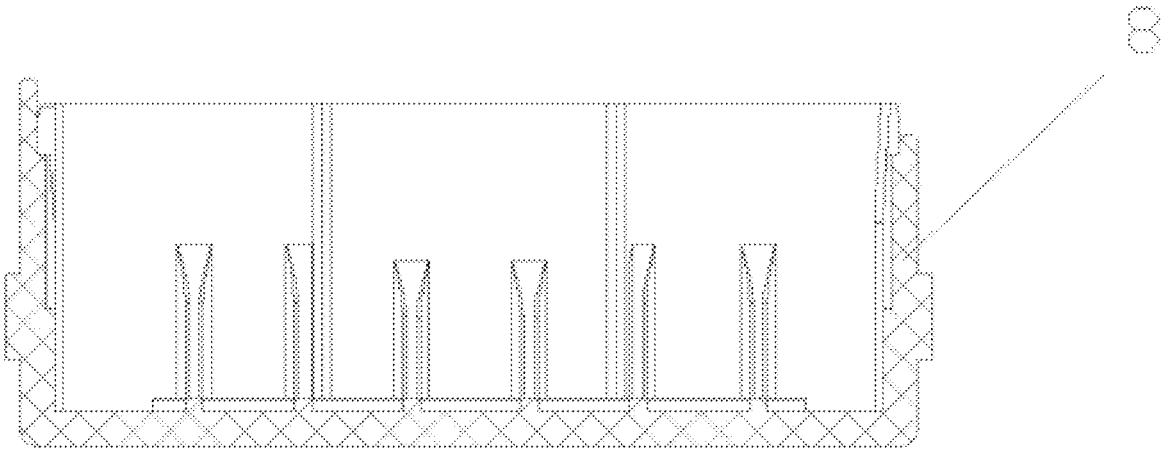
FIG. 44 is a cross-sectional view taken along line I-I of FIG. 43.
Figure 45:
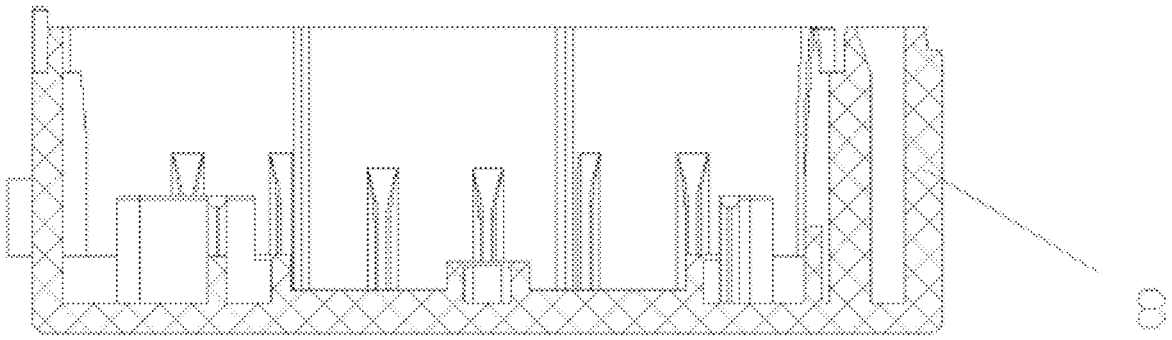
FIG. 45 is a cross-sectional view taken along line J-J of FIG. 43.

Referring to FIG. 24 to FIG. 25, a magnetic latching relay capable of resisting the short-circuit current according to Embodiment 10 of the present invention differs from the above Embodiment 9 in that the axis of the coil of the magnetic circuit system 1 is substantially parallel to the movable spring 713, the movable spring 723, and the movable spring 733 of the contact systems. The cooperate positions of the movable and static contacts of the three contact systems are aligned with respect to the magnetic circuit system 1, and the magnetic circuit system 1 is disposed in the middle of the three contact systems. In the present embodiment, the magnetic circuit system 1 is disposed between the contact system 71 and the contact system 72; of course, it may be disposed between the contact system 72 and the contact system 73. The magnetic circuit system 1 operates with the three movable springs, that is, the movable spring 713, the movable spring 723, and the movable spring 733 by a pushing mechanism 74.

In this embodiment, there are three groups of contact circuits, which are three groups of normally open or normally closed contact circuits.

Embodiment for Magnetic Circuit Positioning

This embodiment provides a magnetic latching relay capable of achieving precise positioning of a magnetic circuit. By improving the cooperating structure between the magnetic circuit portion and the base, it can be ensured that the accuracy of the verticality is not affected by the flatness of the bottom surface of the base after the magnetic circuit portion is installed in the base. Moreover, there is no need for other auxiliary positioning technologies such as dispensing, and the disadvantages of using a glue bond which easily contaminates the working portion of the magnetic circuit portion is eliminated, which greatly improves the production efficiency.

The existing magnetic latching relay design mainly uses interference fit and epoxy glue bonding to position the magnetic circuit portion. The coil bobbin of the magnetic circuit portion is usually mounted on the base in a horizontal manner. During installing, by means of the coil bobbin, the yoke and the base that are already assembled together, a side of the yoke of the magnetic circuit portion is fixed, at the end position of the bobbin, to the iron core passing through a through hole of the bobbin, and another side of the yoke of the magnetic circuit portion cooperates with the armature. In the positive and negative directions of the X-axis (i.e., the horizontal direction perpendicular to the axis of the through-hole of the bobbin), a positioning structure, that is, a positioning groove is added to the base to clamp the yoke in the magnetic circuit portion, that is, the positioning groove is provided on the base to clamp the other side of the yoke. Since the base is made of plastic, the plastic positioning structure will have different degrees of inclination after injection molding of the plastic mold, resulting in poor verticality after assembly of the magnetic circuit, which directly affects the working reliability of the magnetic circuit portion. When the epoxy resin is used for bonding, the glue easily contaminates the working part of the magnetic circuit portion and reduces the production efficiency. In the positive and negative direction of the Y-axis at the mounting of the magnetic circuit portion (i.e., the same horizontal direction as the axis of the bobbin through-hole), the magnetic circuit portion operates with the corresponding portion of the base (corresponding to the width direction of the base) to realize Y-axis positioning. In the negative direction of the Z-axis at the mounting portion of the magnetic circuit portion (i.e., the vertical direction perpendicular to the axis of the through-hole of the bobbin), the positioning is achieved by a large surface of the magnetic circuit portion being in contact with a large surface of the base. The large surface of the magnetic circuit portion includes a bottom end surface of both ends of the coil bobbin (i.e., corresponding to both ends of the through hole), and the bottom end surface of the two bobbins is a mounting surface for cooperating with the base. Due to the uneven pressure, shrinkage deformation and other factors caused by injection molding of the bobbin, it is difficult to ensure that the bottom end faces of the two ends of the coil bobbin are not twisted, and the flatness accuracy often exceeds 0.2 mm (depending on the size of components). Two of the four support faces on the base (in the inner surface) are used to support the bottom end faces of the two ends of the bobbin, and the other two support faces are used to support the bottom end faces of the other side of the yoke fitted at two ends of the bobbin. Since the bobbin and the base are made of plastic, due to uneven pressure of the injection molding and the shrinkage deformation of the bobbin and the base, it is difficult to ensure that the four supporting surfaces and the bottom end faces of the two ends of the bobbin are not twisted, and the flatness accuracy exceeds 0.3 mm (depending on the size of components). The flatness of the mounting surface of the base and the mounting surface of the bobbin in the magnetic circuit portion during the forming of components is poor, which may result in poor verticality after assembly of the magnetic circuit portion, which seriously affects the assembly precision of the magnetic circuit portion of the relay, resulting in poor product performance. The technical solution adopted by the present embodiment to solve the technical problem is described as follows.

Embodiment 1 for Magnetic Circuit Positioning

Referring to FIGS. 26 to 37, a magnetic latching relay capable of accurately positioning a magnetic circuit of the present embodiment includes a magnetic circuit portion and a base 8. The magnetic circuit portion includes a yoke 91, a core 92, an armature (not shown), and a bobbin 94. The iron core 92 is inserted into a through-hole 941 of the bobbin 94, and the yoke 91 comprises two yokes, and one side 911 of each of the two yokes 91 is connected to the iron core 92 respectively at the both ends of the through-hole 941 of the bobbin and. The armature is fitted between the other side 912 of each of the two yokes 91. The magnetic circuit portion is mounted on the base 8, with the axis of the through-hole 941 of the bobbin in a horizontal manner. In the present embodiment, in the two yokes 91, a positioning convex portion 9111 is further provided on the outward face of the side 911 of the yokes. Positioning grooves 84 are formed in the side walls 83 of the base 8 corresponding to the ends of the through holes of the bobbin, respectively, to be engaged with the positioning convex portion 9111 of the yokes to realize the positioning of the magnetic circuit portions on the base 8 in the horizontal direction perpendicular to the axis of the bobbin through hole 941.

In this embodiment, the positioning groove 84 of the side wall of the base has an elongated shape, and the longitudinal direction of the positioning groove 84 is disposed along the vertical direction.

In this embodiment, the positioning groove 84 of the side wall 83 of one side of the base is formed by two outwardly protruding ribs 85 of the side wall.

In this embodiment, the positioning groove of the side wall 83 of the other side base is formed by an inwardly recessed structure of the side wall.

The portion of positioning groove 84 surrounded by the ribs 85 is an end corresponding to the coil head, and the coil is provided with a coil pin at the end. The recessed structure is formed at an end corresponding to the tail of the coil, and the coil has no coil pins at this end.

In the present embodiment, the positioning convex portion 9111 of the yoke is composed of two cylinders which are arranged in the vertical direction.

When the magnetic circuit portion is mounted on the base 8, the bottom end faces 942, 943 of the two ends of the bobbin 94 and the bottom end faces 9121, 9122 of the other sides 912 of the two yokes are mounted as mounting faces on the inner surface of the base 8. A boss for positioning is further disposed among a bottom end surface of both ends of the bobbin, a bottom end surface of each of the other sides of the two yokes, and a corresponding position of the inner surface of the base to realize the positioning of the magnetic circuit portion on the base 8 in a downward direction in the vertical direction perpendicular to the axis of the bobbin through hole.

In this embodiment, the positioning bosses are respectively protruded upward along the inner surface of the base at positions corresponding to the bottom end faces of two ends of the bobbin and the bottom end faces of the other sides of the two yokes. That is, the inner surface of the base 8 is provided with a positioning boss 86 at a mounting portion corresponding to the bottom end surface 942 of the head of the bobbin 94, and the inner surface of the base 8 is provided with a positioning boss 87 at a mounting portion corresponding to the bottom end surface 943 of the tail of the bobbin 94. The bottom end surface 9121 of the inner surface of the base 8 corresponding to the other side 912 of one yoke is provided with a positioning boss 88, and the bottom end surface 9122 of the inner surface of the base 8 corresponding to the other side 912 of the other yoke is provided with a positioning boss 89. Since the bobbin 94, the mounting surface of the yoke 91, and the mounting surface of the base 8 are mounted by small-surface contact, the verticality after assembly can be improved.

In the art, a magnetically permeable member that passes a through hole of a bobbin is generally referred to as an iron core, a magnetically permeable member disposed outside the through hole of the bobbin is referred to as a yoke, and a movable magnetically permeable member is referred to as an armature. The magnetic core, the yoke and the armature constitute a magnetic circuit, and the iron core and the yoke can be separate components, such as the structure described in this embodiment, that is, a straight-shaped iron core and two L-shaped yokes, i.e., three components in total. The iron core and the yoke may also be integrally connected; for example, the iron core and one of the yokes are integrally formed, a U-shaped structure is formed by bending, and the other yoke is still L-shaped, i.e., two components in total. For another example, the iron core and the two yokes are integrated into one body, and an integral part of a C-shaped structure is formed by bending, thus the structure is one-piece. For example, two iron cores are stacked in the through hole of the bobbin, and the two iron cores are respectively integrated with the two yokes, so that two U-shaped structures can be formed by bending, and each side of the two U-shaped structures is inserted into the through hole of the bobbin to form a stacked core, i.e., two components in total.

In the magnetic latching relay capable of accurately positioning the magnetic circuit of the embodiment, two yokes 91 are used. A positioning convex portion 9111 is disposed on an outwardly face of one side 911 of the yoke 91; in the side wall 83 of the base 8 corresponding to two ends of the through hole 941 of the bobbin, a positioning groove 84 is provided which can cooperate with the positioning convex portion 9111 of the yoke, thereby, realizing the positioning of the magnetic circuit portion on the base 8 in a horizontal direction perpendicular to the axis of the bobbin through hole 941. In this embodiment, a boss for positioning (that is, the inside of the base 8) is disposed among the bottom end faces of the two ends of the bobbin, the bottom end faces of the other sides of the two yokes, and the corresponding positions of the inner surfaces of the bases, (the bottom end face 942 of the inner surface of the base 8 corresponding to the head portion of the bobbin 94 is provided with a positioning boss 86, the bottom end face 943 of the inner surface of the base 8 corresponding to the tail portion of the bobbin 94 is provided with a positioning boss 87, the bottom end face 9121 of the inner surface of the base 8 corresponding to the other side 912 of one yoke is provided with a positioning boss 88, and the bottom end face 9122 of the inner surface of the base 8 corresponding to the other side 912 of the other yoke is provided with a positioning boss 89). The positioning of the magnetic circuit portion on the base in a downward direction in the vertical direction perpendicular to the axis of the coil frame through-hole can be achieved. The structure of the embodiment can ensure that the assembly accuracy of the perpendicularity of the magnetic circuit portion is not affected by the flatness of the bottom surface of the base after the base is installed, and the perpendicularity of the magnetic circuit portion after assembling can be within 0.05 mm. Moreover, there is no need for other auxiliary positioning technologies such as dispensing, which eliminates the disadvantages that using a glue bond easily contaminates the working portion of the magnetic circuit portion, thus the production efficiency is greatly improved.

Embodiment 2 for Magnetic Circuit Positioning

Referring to FIG. 38 to FIG. 46, a magnetic latching relay capable of accurately positioning a magnetic circuit of the present embodiment differs from Embodiment 1 in that the positioning boss is disposed at the bobbin and the yoke, and the positioning bosses are respectively formed to protrude downward along the bottom end faces of two ends of the bobbin 94 and the bottom end faces of the other sides 912 of the two yokes 91. Four positioning bosses are disposed, wherein the positioning boss 944 is disposed at the bottom end face 942 of the head of the bobbin 94, the positioning boss 945 is disposed at the bottom end face 943 of the tail of the bobbin 94, the positioning boss 913 is disposed at the bottom end face 9121 of the other side 912 of one yoke, and the positioning boss 914 is disposed at the bottom end face 9222 of the other side 912 of the other yoke.

Embodiment 3 for Magnetic Circuit Positioning

Figure 46:
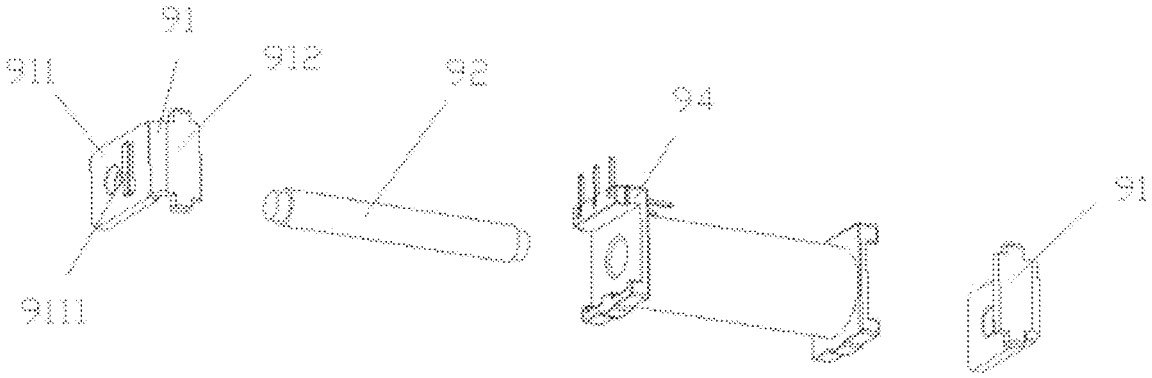
FIG. 46 is an exploded view of the structure of the magnetic circuit portion (without an armature) of Embodiment 3 for magnetic circuit positioning of the present invention.
Figure 47:
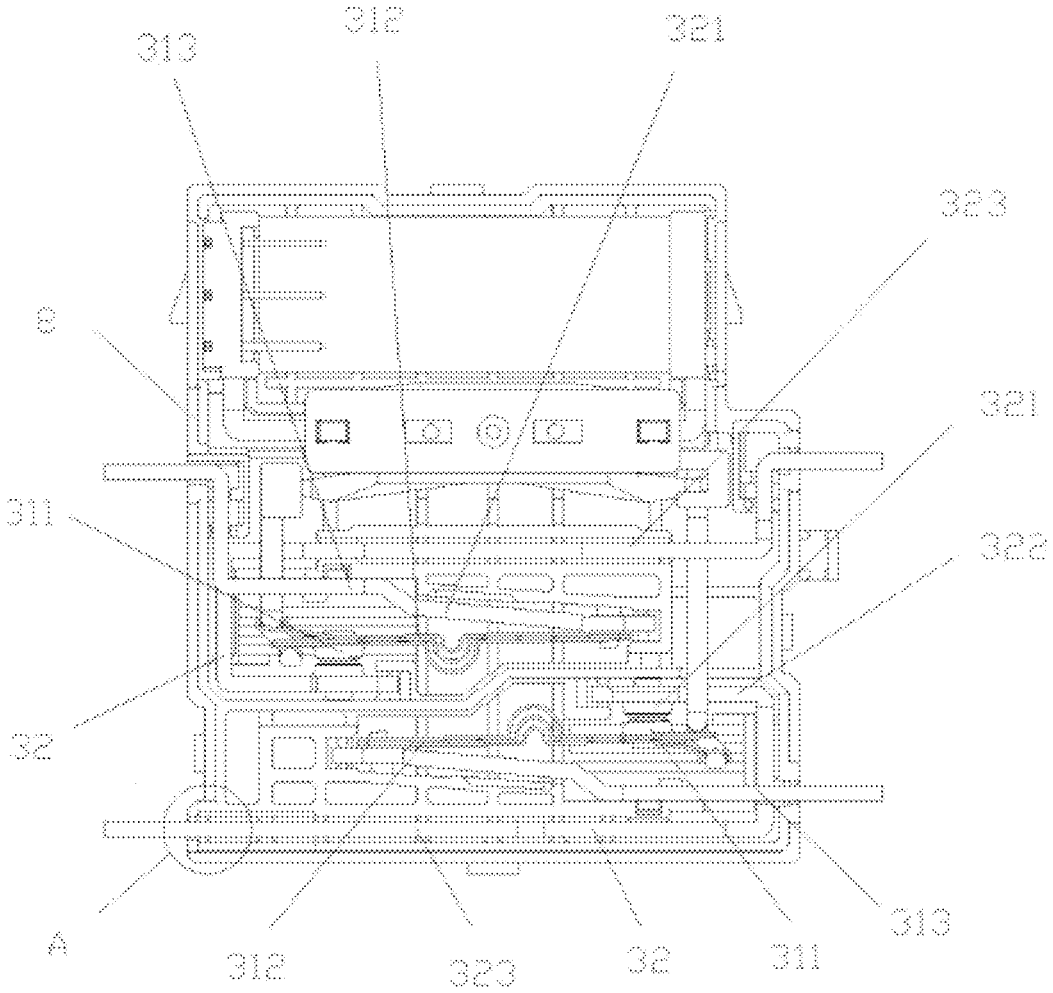
FIG. 47 is a schematic view of the structure of Embodiment for preventing scratch according to the present invention.
Figure 48:
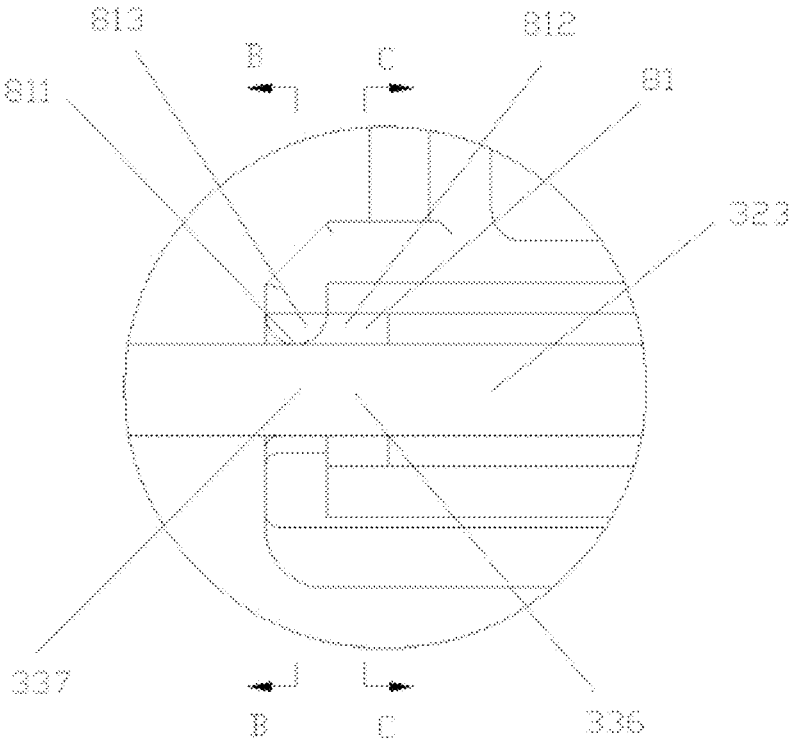
FIG. 48 is an enlarged schematic view of portion A in FIG. 47.
Figure 49:
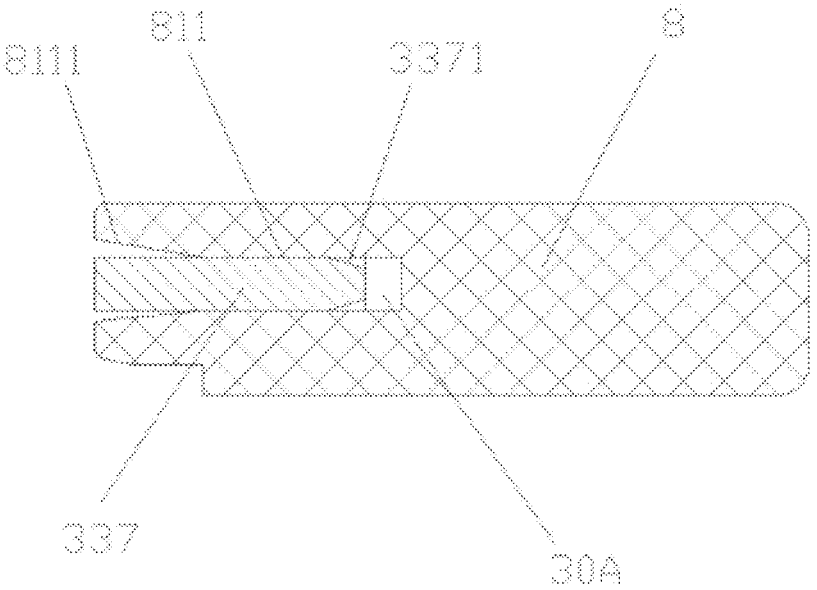
FIG. 49 is a cross-sectional view taken along line B-B of FIG. 48.
Figure 50:
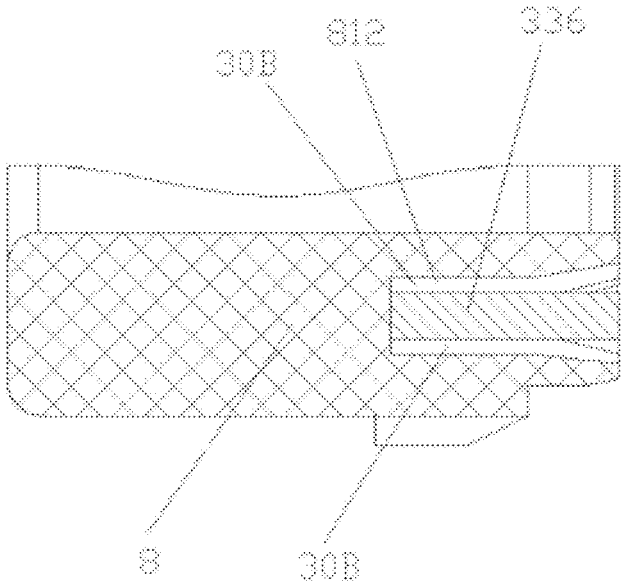
FIG. 50 is a cross-sectional view taken along line C-C of FIG. 48.
Figure 51:
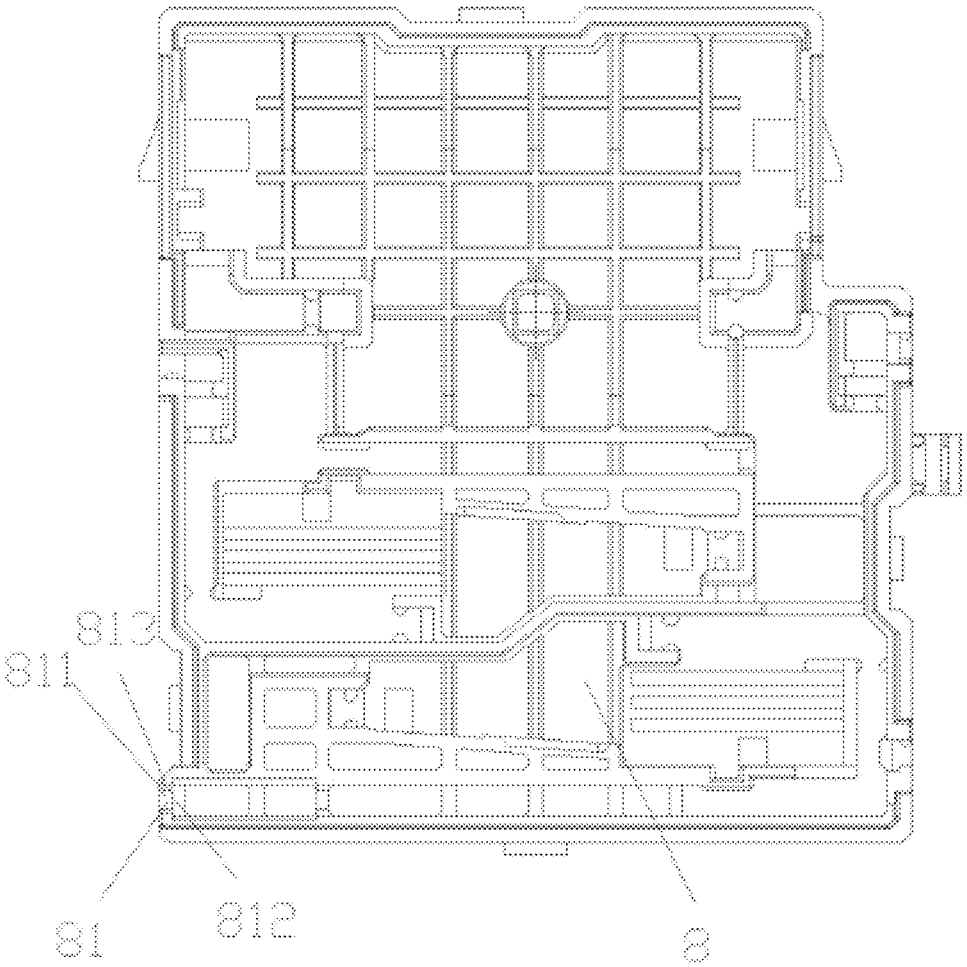
FIG. 51 is a schematic view of a base of Embodiment for preventing scratch according to the present invention.
Figure 52:
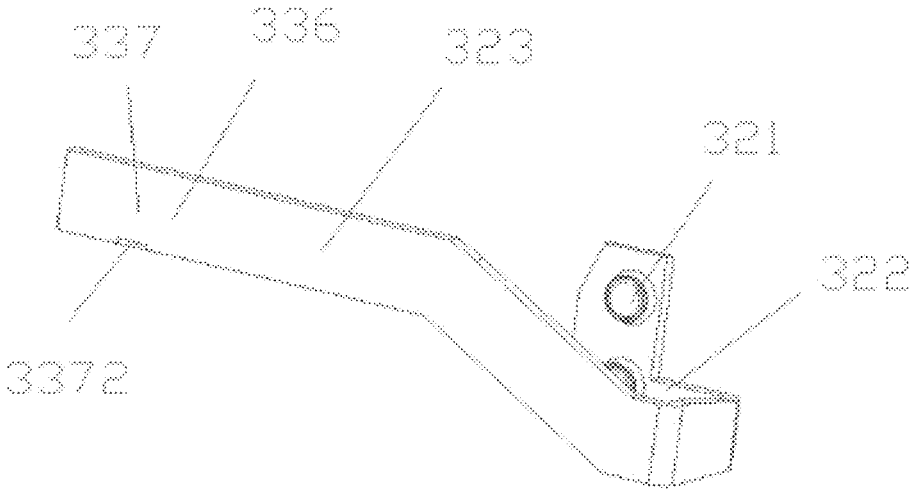
FIG. 52 is a schematic view of a spring portion of Embodiment for preventing scratch according to the present invention.

Referring to FIG. 46, a magnetic latching relay capable of accurately positioning a magnetic circuit of the present embodiment differs from the Embodiment 2 in that the positioning convex portion 9111 of the yoke 91 is composed of a rectangular parallelepiped, the length direction of which is along the vertical direction.

In the above embodiment for magnetic circuit positioning, since at least one yoke of the two yokes is provided with a positioning convex portion on the outward side of one side of the yoke, at least one side wall of the side walls of two ends of the base corresponding to the through hole of the bobbin is provided with a positioning groove that can cooperate with the positioning convex portion of the yoke. Thus, positioning of the magnetic circuit portion on the base in a horizontal direction perpendicular to the axis of the through hole of the coil bobbin is achieved. The embodiment of the invention also adopts a boss for positioning among the bottom end faces of the two ends of the bobbin, the bottom end faces of the other sides of the two yokes, and the corresponding positions of the inner surfaces of the bases to realize the magnetic circuit portion being positioned on the base in the downward direction of the vertical direction perpendicular to the axis of the through hole of the coil frame. Therefore, it can be ensured that the assembly accuracy of the verticality of the magnetic circuit portion after being mounted in the base is not affected by the flatness of the bottom surface of the base, and the perpendicularity of the magnetic circuit portion after assembly can be within 0.05 mm. Other auxiliary positioning technologies such as dispensing are not required. The disadvantages of using a glue bond to easily contaminate the working portion of the magnetic circuit portion are eliminated, which greatly improves the production efficiency.

Embodiment for Preventing Scraping

The present embodiment provides a magnetic latching relay in which the contact portion is assembled with function of anti-scraping and is positioned accurately. By improving the matching structure between the insertion portion of the contact portion and the base slot, the generation of scrapings can be prevented, and the precise positioning of the contact portion in the base can be ensured, thereby achieving dual design of anti-scrapping and positioning in a small space.

Since the magnetic latching relay has a large load current (5 A to 200 A), the heat generation will be large if energization is made in long time. It is required that the magnetic latching relay operates reliably during the closing operation, the contact portion is in constant contact and conduction after the closing operation, and the contact portion can be reliably disconnected after pulling operation. The contact portion is usually mounted on the base, the contact portion is a metal member, and the base is a plastic member. When the contact portion is mounted on the base, the insertion portion of the metal member (such as the static spring, the static spring lead, the movable spring lead, etc.) is usually inserted into the slot of the plastic part (i.e., the base). Metal parts scraping plastic parts during assembly to produce plastic chips have always been a problem in the relay industry. In order to reduce the plastic chips, it is generally chamfered on the insertion side of the metal member. The chamfer is usually formed by pressing. In this way, the periphery of the press-in portion will bulge outward, and the chamfered position is often a positioning reference of the insertion direction, and the outward bulging formed after the chamfering process is bound to cause the positioning reference size to be uncontrolled or result in a high cost on the mold. The technical solution adopted by the embodiment to solve the technical problem is described as follows.

Referring to FIG. 47 to FIGS. 52, a magnetic latching relay of the present embodiment, whose contact portion is provided with a function of anti-scraping and is accurately positioned, includes a contact portion and a base 8. The contact portion includes a movable spring portion 31 and a static spring portion 32. The movable spring portion 31 includes a movable contact 311, a movable spring 312 and a movable spring lead 313. An end of the movable spring 312 is connected to the movable contact 311, and another end of the movable spring 312 is connected to an end of the movable spring lead 313. Another end of the movable spring lead extends outside the magnetic latching relay. The static spring portion 32 includes a static contact 321, a static spring 322 and a static spring lead 323. An end of the static spring 322 is connected to the static contact 321, and another end of the static spring 322 is connected to an end of the static spring lead 323. Another end of the static spring lead 323 extends outside the magnetic latching relay. The static contact 321 is disposed at a position adapted to the movable contact 311. This embodiment employs two groups of the movable spring portions 31 and the static spring portions 32. A metal insertion portion provided on each of the movable spring lead 313, the static spring 322 and the static spring lead 323 respectively corresponds to the slots of the base. Hereinafter, the structural features of the present embodiment will be described by taking the cooperation of the static spring lead 323 and the slot 81 of the base 8 as an example.

The metal insertion portion of the static spring lead 323 is constituted by two segments having different depth dimensions corresponding to the slot 81. When one of the segments 336 of the metal insertion portion of the static spring lead 323 is fitted to the bottom wall of the slot 81, a preset gap 30A is formed between the other segment 337 of the metal insertion portion of the static spring lead 323 and the bottom wall of the slot 81 of the base. The slot 81 is composed of two segments having different thickness dimensions corresponding to the metal insertion portions of the static spring lead 323. When the two side walls of one segment 811 of the slot 81 are fitted to both sides of the thickness of the metal insertion portion of the static spring lead 323, the two side walls of the other segment 812 of the slot 81 and the two sides of the thickness of the metal insertion portion of the static spring lead 323 respectively form a preset gap 30B. The depth dimensions of the two segments of the slot 81 are identical; the thickness dimensions of the two segments of the metal insertion portion of the static spring lead 323 are identical. One of the segments 336 of the metal insertion portion of the static spring lead 323 cooperates with the other segment 812 of the slot, and the other segment 337 of the metal insertion portion of the static spring lead 323 cooperates with the segment 811 of the slot.

In the present embodiment, the segment 337 of the metal insertion portion of the static spring lead 323 is formed by a notch 3372 provided on the contact portion at the bottom side.

In the present embodiment, the bottom ends 3371 of two sides of the thickness of the segment 337 of the metal insertion portion of the static spring lead 323 are chamfered.

In the present embodiment, the upper ends 8111 of the two side walls of one segment 811 of the slot 81 of the base 8 are chamfered.

In the present embodiment, one segment 811 of the slot 81 of the base 8 is formed by adding a rib 813 along the depth direction of the slot to the two side walls of the slot of the base.

A magnetic latching relay of the present embodiment, whose contact portion is provided with a function of anti-scraping and is accurately positioned, has a metal insertion portion designed to be composed of two segments having different depth dimensions corresponding to the slot 81. When one segment 336 of the metal insertion portion is fitted to the bottom wall of the slot 81, a preset gap 30A is formed between the other segment 337 of the metal insertion portion and the bottom wall of the slot 81 of the base. The slot 81 is designed to be composed of two segments having different thickness dimensions corresponding to the metal insertion portions. When the two side walls of one segment 811 of the slot are adapted to the two sides of the thickness of the metal insertion portion, the two side walls of the other segment 812 of the slot 81 and the two sides of the thickness of the metal insertion portion respectively form a preset gap 30B. One segment 336 of the metal insertion portion operates with the other section 812 of the slot, and the other section 337 of the metal insertion section operates with the section 811 of the slot. In the present embodiment, the other section 337 of the metal insertion portion cooperates with one of the slots 811 of the slot, and in the case of a corresponding thickness, the chamfering structure of the bottom end 3371 of the other section 337 of the metal insertion portion can be utilized to reduce the generation of scrapings. By the cooperation of one of the segments 336 of the metal insertion portion and the other segment 812 of the slot, the non-corresponding thickness (i.e., creating a gap) can be utilized to prevent the metal insertion portion from scraping the sidewall of the slot 81. In this embodiment, another segment 337 of the metal insertion portion cooperates with one of the segments 811 of the slot, and positioning in the thickness direction of the metal member can be achieved in the case of corresponding thickness. By the cooperation of one of the segments 336 of the metal insertion portion and the other segment 812 of the slot, positioning in Z-direction of the metal member (i.e., the depth direction of the slot) can be achieved by the cooperation of the metal member and the bottom wall of the slot.

This embodiment utilizes a first portion of the metal insertion portion (i.e., the other segment of the metal insertion portion) to cooperate with the first portion of the slot (i.e., one segment of the slot) to form a structural feature which has a widthwise fit and a gap in depth direction, and utilizes a second portion of the metal insertion portion (i.e., one segment of the metal insertion portion) to cooperate with the second portion of the slot (i.e., the other segment of the slot) to form a structural feature which has a fit in depth-direction and a gap in the thickness direction. Therefore, when the metal insertion portion cooperates with the slot, there is a fit in each of the thickness direction and the depth direction, so as to achieve positioning with reference, and the generation of scrapings can be prevented in the portion where the gap exists. In this embodiment, the generation of the scrapings can be prevented, and the precise positioning of the contact portion in the base can be ensured, thereby realizing a dual design of preventing scrapings and positioning in a small space.

The above description is only preferred embodiments of the invention and is not intended to limit the invention in any way. While the invention has been described above in the preferred embodiments, it is not intended to limit the invention. Those skilled in the art can make many possible variations and modifications to the technical solutions of the present invention by using the above-disclosed technical contents, or modify them to equivalent embodiments without departing from the scope of the technical solutions of the present invention. Therefore, any simple modifications, equivalent changes, and modifications to the above embodiments in accordance with the teachings of the present invention should fall within the scope of the present invention.

What is claimed is:

1. A magnetic latching relay capable of accurately positioning a magnetic circuit, comprising a magnetic circuit portion and a base, the magnetic circuit portion comprising a yoke, an iron core, an armature, and a bobbin, wherein the iron core is inserted into a through-hole of the bobbin, and the yoke comprises two yokes, and one side of each of the two yokes is connected to the iron core respectively at the both ends of the through-hole of the bobbin, and the armature is fitted between the other side of each of the two yokes, the magnetic circuit portion is mounted on the base, with the axis of the through-hole of the bobbin in a horizontal manner;

in at least one of the two yokes, a positioning convex portion is further provided on the outward face of the side of the yoke, positioning grooves are formed in at least one side wall to be engaged with the positioning convex portion of the yoke, to realize the positioning of the magnetic circuit portions on the base in the horizontal direction perpendicular to the axis of the bobbin through hole.

2. The magnetic latching relay capable of accurately positioning a magnetic circuit according to claim 1, wherein the positioning groove of the side wall of the base has an elongated shape, and the longitudinal direction of the positioning groove is disposed along the vertical direction.

3. The magnetic latching relay capable of accurately positioning a magnetic circuit according to claim 2, wherein the positioning groove of the side wall of the base is formed by two ribs of the side wall which are outwardly protruding and along the vertical direction.

4. The magnetic latching relay capable of accurately positioning a magnetic circuit according to claim 2, wherein the positioning groove of the side wall of the base is formed by an inwardly recessed structure of the side wall.

5. The magnetic latching relay capable of accurately positioning a magnetic circuit according to claim 2, wherein the positioning convex portion of the yoke is composed of two cylinders which are arranged in the vertical direction.

6. The magnetic latching relay capable of accurately positioning a magnetic circuit according to claim 2, wherein the positioning convex portion of the yoke is composed of a rectangular parallelepiped, the length direction of which is along the vertical direction.

7. The magnetic latching relay capable of accurately positioning a magnetic circuit according to claim 1, wherein when the magnetic circuit portion is mounted on the base, the bottom end faces of the two ends of the bobbin and the bottom end faces of the other sides of the two yokes are mounted as mounting faces on the inner surface of the base. A boss for positioning is further disposed among a bottom end surface of both ends of the bobbin, a bottom end surface of each of the other sides of the two yokes, and a corresponding position of the inner surface of the base to realize the positioning of the magnetic circuit portion on the base in a downward direction in the vertical direction perpendicular to the axis of the bobbin through hole.

8. The magnetic latching relay capable of accurately positioning a magnetic circuit according to claim 7, wherein the positioning bosses are respectively formed to protrude downward along the bottom end faces of two ends of the bobbin and the bottom end faces of the other sides of the two yokes.

9. The magnetic latching relay capable of accurately positioning a magnetic circuit according to claim 7, wherein the positioning bosses are respectively protruded upward along the inner surface of the base at positions corresponding to the bottom end faces of two ends of the bobbin and the bottom end faces of the other sides of the two yokes.

* * * * *